US008944556B2

(12) United States Patent
Hihara et al.

(10) Patent No.: US 8,944,556 B2
(45) Date of Patent: Feb. 3, 2015

(54) IMAGE FORMING APPARATUS AND IMAGE FORMING METHOD

(71) Applicants: Takeshi Hihara, Kanagawa (JP); Yuuma Usui, Kanagawa (JP); Takeo Tsukamoto, Kanagawa (JP); Manabu Seo, Kanagawa (JP); Takahiko Matsumoto, Kanagawa (JP); Hiroyuki Yamashita, Kanagawa (JE); Hideomi Sakuma, Kanagawa (JP); Aino Hasegawa, Kanagawa (JP); Ryota Suzuki, Tokyo (JP); Hisayoshi Ohshima, Kanagawa (JP); Shigeo Takeuchi, Kanagawa (JP); Mizuki Otagiri, Kanagawa (JP)

(72) Inventors: Takeshi Hihara, Kanagawa (JP); Yuuma Usui, Kanagawa (JP); Takeo Tsukamoto, Kanagawa (JP); Manabu Seo, Kanagawa (JP); Takahiko Matsumoto, Kanagawa (JP); Hiroyuki Yamashita, Kanagawa (JE); Hideomi Sakuma, Kanagawa (JP); Aino Hasegawa, Kanagawa (JP); Ryota Suzuki, Tokyo (JP); Hisayoshi Ohshima, Kanagawa (JP); Shigeo Takeuchi, Kanagawa (JP); Mizuki Otagiri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/970,091

(22) Filed: Aug. 19, 2013

(65) Prior Publication Data

US 2014/0071196 A1 Mar. 13, 2014

(30) Foreign Application Priority Data

Sep. 12, 2012 (JP) ..... 2012-200455

(51) Int. Cl.

| | |
|---|---|
| ***B41J 29/38*** | (2006.01) |
| ***B41J 2/015*** | (2006.01) |
| ***B41J 2/045*** | (2006.01) |
| ***B41J 2/005*** | (2006.01) |
| ***B41M 5/00*** | (2006.01) |

(Continued)

(52) U.S. Cl.

CPC ..... *B41J 2/04553* (2013.01); *B41J 2/0057* (2013.01); *B41M 5/0017* (2013.01); *B41J 2/2114* (2013.01); *B41J 11/0015* (2013.01)

USPC ..... 347/16; 347/17; 347/21

(58) Field of Classification Search

CPC ..... B41J 2/04553

USPC ..... 347/16–17, 21

See application file for complete search history.

(56) References Cited

U.S. PATENT DOCUMENTS

| | | | |
|---|---|---|---|
| 6,196,674 | B1 | 3/2001 | Takemoto |
| 7,281,790 | B2 | 10/2007 | Mouri et al. |
| 8,011,781 | B2 | 9/2011 | Taniuchi et al. |

(Continued)

FOREIGN PATENT DOCUMENTS

| | | |
|---|---|---|
| JP | 5-096720 | 4/1993 |
| JP | 8-020159 | 1/1996 |

(Continued)

OTHER PUBLICATIONS

European Search Report dated Jan. 13, 2014 in corresponding European patent application No. 13 18 3250.3.

*Primary Examiner* — Jason Uhlenhake

(74) *Attorney, Agent, or Firm* — Cooper & Dunham LLP

(57) ABSTRACT

Disclosed is an image forming apparatus including a head configured to discharge an aqueous recording liquid onto a recording medium; and a coating unit configured to apply a process liquid onto the recording medium, wherein the process liquid is formed by emulsifying, by a first surfactant, water including a water-soluble polymer and a low polarity solvent which is not compatible with the water, wherein the water and the low polarity solvent are emulsified as a W/O emulsion in which the water is in a dispersed phase and the low polarity solvent is in a continuous phase.

7 Claims, 3 Drawing Sheets

(51) Int. Cl.
*B41J 2/21* (2006.01)
*B41J 11/00* (2006.01)

(56) References Cited

U.S. PATENT DOCUMENTS

| | | | | |
|---|---|---|---|---|
| 8,382,233 | B2 | 2/2013 | Usui et al. | |
| 2003/0234837 | A1* | 12/2003 | Pan et al. | 347/84 |
| 2008/0006176 | A1 | 1/2008 | Houjou | |
| 2011/0273523 | A1 | 11/2011 | Tsukamoto et al. | |
| 2011/0303113 | A1 | 12/2011 | Sarkisian et al. | |
| 2013/0050363 | A1 | 2/2013 | Usui et al. | |
| 2013/0057628 | A1 | 3/2013 | Suzuki et al. | |
| 2013/0093810 | A1 | 4/2013 | Suzuki et al. | |

FOREIGN PATENT DOCUMENTS

| | | | |
|---|---|---|---|
| JP | 8-142500 | | 6/1996 |
| JP | 10-250216 | | 9/1998 |
| JP | 11-010856 | | 1/1999 |
| JP | 11-188858 | | 7/1999 |
| JP | 2000-044855 | | 2/2000 |
| JP | 2000-063719 | | 2/2000 |
| JP | 2000-343808 | | 12/2000 |
| JP | 3158682 | | 4/2001 |
| JP | 2002-370441 | | 12/2002 |
| JP | 2003-082265 | | 3/2003 |
| JP | 3428689 | | 7/2003 |
| JP | 2003-246135 | | 9/2003 |
| JP | 2003246135 | A * | 9/2003 |
| JP | 3461202 | | 10/2003 |
| JP | 3658765 | | 6/2005 |
| JP | 2008-019286 | | 1/2008 |
| JP | 2010-173201 | | 8/2010 |
| JP | 2010-188665 | | 9/2010 |
| JP | 2010-247381 | | 11/2010 |
| JP | 2010-253807 | | 11/2010 |
| JP | 2011-084041 | | 4/2011 |
| JP | 2011-167885 | | 9/2011 |
| JP | 2011-235589 | | 11/2011 |
| JP | 4829843 | | 12/2011 |
| JP | 4834300 | | 12/2011 |
| JP | 2012-052027 | | 3/2012 |
| JP | 2012-111867 | | 6/2012 |
| JP | 2013-060574 | | 4/2013 |

* cited by examiner

IMAGE FORMING APPARATUS AND IMAGE FORMING METHOD

BACKGROUND OF THE INVENTION

1. Field of the Invention

The present invention relates to an inkjet image forming apparatus and an image forming method. The image forming apparatus forms an image by discharging a recording liquid such as ink through a head.

2. Description of the Related Art

An image forming apparatus such as an inkjet printer has been known which includes a head that discharges a recording liquid such as ink through a plurality of nozzles and which performs inkjet recording (e.g., Patent Document 1 (Japanese Unexamined Patent Publication No. 2003-82265), Patent Document 2 (Japanese Unexamined Patent Publication No. 2003-246135), and Patent Document 3 (Japanese Unexamined Patent Publication No. 2000-343808)).

Since, during the inkjet recording, ink is discharged through a fine nozzle (e.g., several tens of micrometers), a highly soluble dye has been used as colorant of the ink to address a problem such as clogging of the nozzle. Dye ink is so excellent in color developing property that, for photographic printing, image quality of the dye ink is equivalent to that of silver halide photography. However, the dye ink is poor in image preservability, such as water resisting property, light resistance, or gas resisting property. To compensate for this problem, pigment has been used as colorant of ink. The pigment has been used for a large format printer for industrial use. Currently, the pigment is also used for a printer for personal use and a printer for office use.

When a color image is printed on a plain paper sheet, bleeding tends to occur in a color boundary, such as a two-color superposed portion, and feathering tends to occur in the vicinity of a printed portion, such as the vicinity of a character or a thin line. Techniques have been proposed to suppress such bleeding and feathering. In the techniques, a liquid or fine particles are used (e.g., Patent Documents 1, 2, and 3). For example, in Patent Document 1, an image forming technique has been proposed such that a process liquid including a polyvalent metal salt, which reacts with colorant included in ink and demonstrates a condensation effect, is utilized, and the ink is discharged onto a portion to which the process liquid is adhered. Further, for example, in Patent Document 2, an image forming technique has been proposed such that a process liquid including a cationic high molecular compound and a surfactant and/or a wetting accelerator is utilized, and ink is discharged onto a portion to which the process liquid is adhered. Further, for example, in Patent Document 3, a technique has been proposed such that a layer of water-absorbing resin fine particles (e.g., polyacrylic acid) is provided on a surface of an intermediate transfer body. In this technique, ink is applied onto the intermediate transfer body. The moisture of the ink is absorbed by the water-absorbing resin fine particles. Subsequently, the water-absorbing resin fine particles are transferred onto a recording medium together with the ink.

The technique which utilizes the process liquid including the polyvalent metal salt is effective for preventing the bleeding and the feathering. Unfortunately, when this technique is utilized, unevenness occurs within a dot. The technique which utilizes the process liquid including the cationic high molecular compound is effective for preventing the bleeding and the feathering. Unfortunately, since the cationic polymer is dissolved in the process liquid, the viscosity of the process liquid is high, and it is difficult to uniformly apply the process liquid. The application unevenness can be a cause of image distortion. Moreover, in this technique, the process liquid is an aqueous process liquid. When such a process liquid is applied to a plain paper sheet, curling and waviness tend to occur. Further, for a case in which the process liquid is applied to the intermediate transfer body, it is difficult to evenly apply the process liquid, as described above. Thus, the transfer efficiency is low, and the image density becomes low. In the technique in which the water-absorbing resin fine particles are utilized, excellent image quality is achieved even on a plain paper sheet, provided that a condition of the water-absorbing resin fine particles is good. Unfortunately, it is possible that, when the water-absorbing resin fine particles are stored, the water-absorbing resin fine particles absorb the moisture, and the water-absorbing resin fine particles are aggregated. In this case, it is difficult to uniformly apply the water-absorbing resin fine particles, and image distortion may be caused.

Accordingly, there is a need for an inkjet Image forming device and an image forming method such that they prevent feathering, bleeding, and curling, even if a plain sheet of paper is used as a recording medium, and such that they can form a high quality image by using a process liquid, which can be easily applied uniformly, and which can be relatively easily stored.

SUMMARY OF THE INVENTION

According to one aspect of the present invention, there is provided an image forming apparatus including a head configured to discharge an aqueous recording liquid onto a recording medium; and a coating unit configured to apply a process liquid onto the recording medium, wherein the process liquid is formed by emulsifying, by a first surfactant, water including a water-soluble polymer and a low polarity solvent which is not compatible with the water, wherein the water and the low polarity solvent are emulsified as a W/O emulsion in which the water is in a dispersed phase and the low polarity solvent is in a continuous phase.

According to another aspect of the present invention, there is provided an image forming method of forming an image, the method including a first step of using a head configured to discharge an aqueous recording liquid onto a recording medium; and a second step of using a coating unit configured to apply a process liquid onto the recording medium, wherein the process liquid is formed by emulsifying, by a first surfactant, water including a water-soluble polymer and a low polarity solvent which is not compatible with the water, wherein the water and the low polarity solvent are emulsified as a W/O emulsion in which the water is in a dispersed phase and the low polarity solvent is in a continuous phase.

The image forming apparatus includes the head that discharges an aqueous recording liquid onto a recording medium; and the coating unit that applies a process liquid onto the recording medium. Here, the process liquid is formed by emulsifying, by the first surfactant, the water including the water-soluble polymer and the low polarity solvent which is not compatible with the water. The water and the low polarity solvent are emulsified as the W/O emulsion in which the water is in the dispersed phase and the low polarity solvent is in the continuous phase. Accordingly, even if a plain sheet of paper is used as the recording medium, feathering, bleeding, and curling are suppressed. The image forming apparatus can form a high quality image by using the process liquid. The process liquid can be easily applied uniformly onto the recording medium. It is relatively easy to store the process liquid.

Other objects, features and advantages of the present invention will become more apparent from the following detailed description when read in conjunction with the accompanying drawings.

DETAILED DESCRIPTION OF THE PREFERRED EMBODIMENTS

Figure 1:
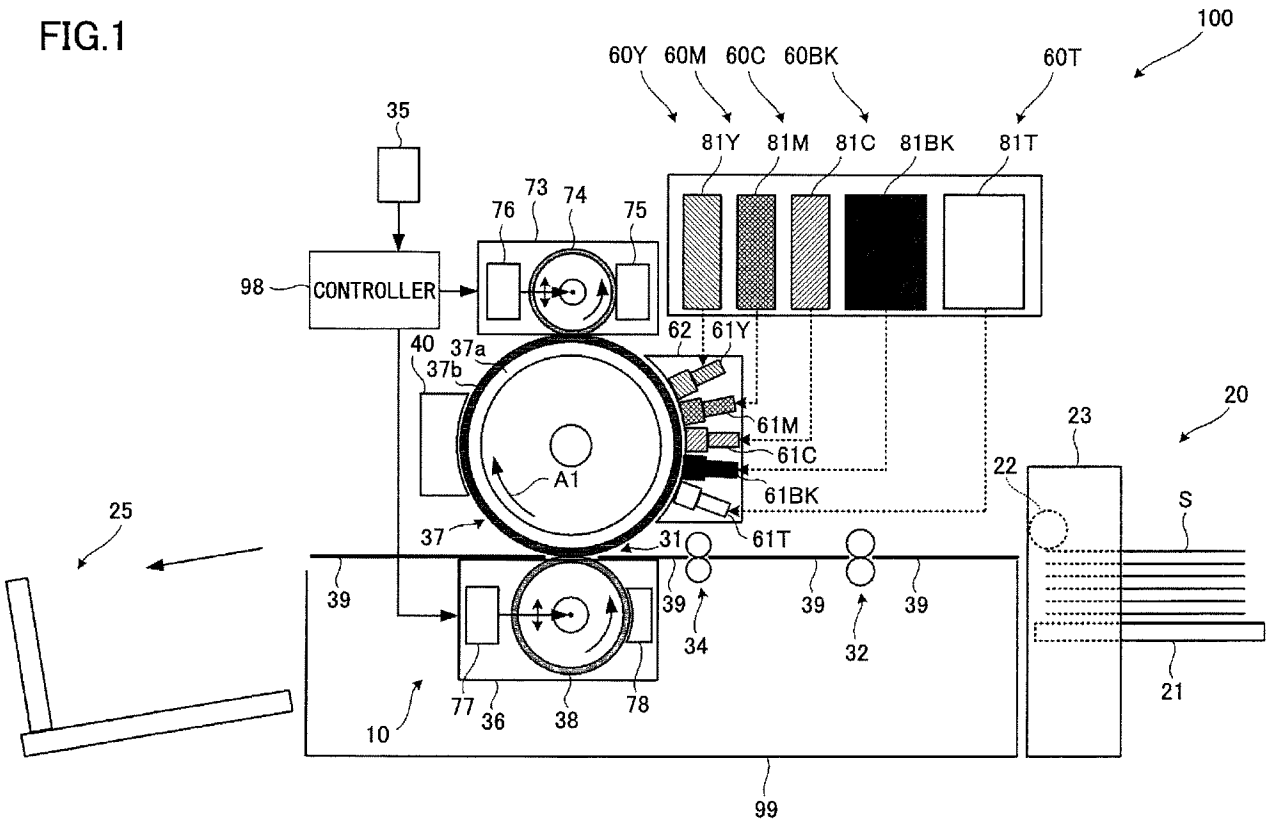
FIG. 1 is a schematic front view of an image forming apparatus according to an example.

FIG. 1 schematically shows an image forming apparatus according to an embodiment of the present invention. The image forming apparatus 100 is an inkjet printer. The image forming apparatus 100 can form a full-color image. The image forming apparatus 100 performs an image forming process based on an image signal. The image signal corresponds to image information which is received from an external device.

The image forming apparatus 100 can form an image on a plain paper sheet, which is generally used for copying. Additionally, the image forming apparatus 100 can form an image on a sheet-like recording medium, such as an OHP sheet; a thick paper sheet such as a card or a post card; or an envelope. The image forming apparatus 100 is a single-sided image forming apparatus that can form an image on a single side of a transfer paper sheet S as a recording paper sheet (which is a recording medium). However, the image forming apparatus 100 may be a double-sided image forming apparatus.

The image forming apparatus 100 includes heads 61Y, 61M, 61C, and 61BK as recording heads. The heads 61Y, 61M, 61C, and 61BK can form a yellow image, a magenta image, a cyan image, and a black image, respectively. Here, an image is color decomposed into the yellow image, the magenta image, the cyan image, and the black image. The heads 61Y, 61M, 61C, and 61BK are recording liquid discharge bodies that discharge corresponding recording liquids, which are yellow ink, magenta ink, cyan ink, and black ink, respectively. Additionally, the image Forming apparatus 100 includes a head 61T as a recording head. The head 61T is a recording liquid discharge body that discharges a recording liquid, which is colorless and transparent ink.

The heads 61Y, 61M, 61C, 61BK, and 61T (as recording heads) are disposed at corresponding positions facing an outer peripheral surface of an intermediate transfer body 37 as an intermediate transfer roller. The intermediate transfer body 37 is an intermediate transfer drum which is disposed substantially at a center portion of a main body 99 of the image forming apparatus 100. The heads 61Y, 61M, 61C, 61BK, and 61T are arranged in this order from an upstream side to a downstream side in the A1 direction in FIG. 1. The A1 direction, which is a clockwise direction in FIG. 1, is a moving direction of the intermediate transfer body 37. In FIG. 1, Y, M, C, BK, and T, which are attached to the reference numerals, indicate that the corresponding elements are for yellow, for magenta, for cyan, for black, and for colorless and transparent, respectively.

The heads 61Y, 61M, 61C, and 61BK are included in ink discharge devices 60Y, 60M, 60C, and 60BK, respectively. The ink discharge devices 60Y, 60M, 60C, and 60BK are recording liquid discharge devices for forming a yellow (Y) image, a magenta (M) image, a cyan (C) image, and a black (BK) image, respectively. The head 61T is included in an ink discharge device 60T. The ink discharge device 60T is a recording liquid discharge device for forming a colorless and transparent (T) image. Here, the head 61Y is a line head. Namely, a plurality of heads 61Y is included in the ink discharge device 60Y, while the heads 61Y are arranged in line in a direction perpendicular to the paper surface of FIG. 1. The head 61M is a line head. Namely, a plurality of heads 61M is included in the ink discharge device 60M, while the heads 61M are arranged in line in the direction perpendicular to the paper surface of FIG. 1. The head 61C is a line head. Namely, a plurality of heads 61C is included in the ink discharge device 60C, while the heads 61C are arranged in line in the direction perpendicular to the paper surface of FIG. 1. The head 61BK is a line head. Namely, a plurality of heads 61BK is included in the ink discharge device 60BK, while the heads 61BK are arranged in line in the direction perpendicular to the paper surface of FIG. 1. The head 61T is a line head. Namely, a plurality of heads 61T is included in the ink discharge device 60T, while the heads 61T are arranged in line in the direction perpendicular to the paper surface of FIG. 1.

While the intermediate transfer body 37 is rotating in the A1 direction, the yellow recording liquid, the magenta recording liquid, the cyan recording liquid, and the black recording liquid are discharged onto and adhered to peripheral surface areas of the intermediate transfer body 37 facing the corresponding heads 61Y, 61W, 61C, and 61BK, so that the yellow recording liquid, the magenta recording liquid, the cyan recording liquid, and the black recording liquid are sequentially superposed. While the intermediate transfer body 37 is rotating in the A1 direction, the colorless and transparent recording liquid is discharged onto and adhered to a peripheral surface area of the intermediate transfer body 37 facing the head 61T. Here, the colorless and transparent recording liquid is discharged onto and adhered to a second area of the peripheral surface of the intermediate transfer body 37, which is different from a first area of the peripheral surface of the intermediate transfer body 37 to which the yellow recording liquid, the magenta recording liquid, the cyan recording liquid, and the black recording liquid are adhered. In this manner, the intermediate transfer body 37 functions as a recording medium such that a primary image is formed on a primary image forming surface, which is the peripheral surface of the intermediate transfer body 37. The image forming apparatus 100 has a tandem structure such that the heads 61Y, 61M, 61C, and 61BK face the intermediate transfer body 37, while the heads 61Y, 61M, 61C, and 61BK are arranged in the A1 direction.

Discharging (application) of the corresponding colors of ink by the heads 61Y, 61M, 61C, 61BK, and 61T onto the intermediate transfer body 37 is performed from the upstream side to the downstream side in the A1 direction, while shifting the timing of the discharging. In this manner, a yellow image area, a magenta image area, a cyan image area, and a black image area are superposed onto the same position on the peripheral surface of the intermediate transfer body 37, thereby forming the image on the first area. A colorless and transparent image area is formed on the second area.

The first area is an image portion where a user's desired image is formed, within an image formable area onto which the recording liquids can be applied by the heads 61Y, 61M, 61C, 61BK, and 61T. The second area is a non-image portion where an inverted image of the user's desired image is formed, within the image formable area.

Composition of the recording liquids which are discharged by the corresponding heads 61Y, 61M, 61C, 61BK, and 61T is described later. As for the recording liquid which is discharged by the head 61T, it suffices if it does not prevent the formation of the image by the recording liquids which are discharged by the head 61Y, 61M, 61C, and 61BK. Accordingly, the color of the recording liquid which is discharged by the head 61T is not limited to colorless and transparent. For example, the color may be white.

As shown in FIG. 1, the image forming apparatus 100 includes the ink discharge devices 60Y, 60M, 60C, 60BK, and 60T, which include the head 61Y, 61M, 61C, 61BK, and 61T, respectively. The image forming apparatus 100 includes a conveyor unit 10 as a document conveyor which conveys a transfer paper sheet S in accordance with the rotation of the intermediate transfer body 37 in the A1 direction. The conveyor unit 10 includes the intermediate transfer body 37. The image forming apparatus 100 also includes a paper feed unit 20. Several transfer paper sheets S can be stacked on the paper feed unit 20. The paper feed unit 20 only feeds the top-most transfer paper sheet S to the conveyor unit 10 among the transfer paper sheets S which are stacked on the paper feed unit 20. The image forming apparatus 100 also includes a paper discharge tray 25. Many printed transfer paper sheets S (the transfer paper sheets S on which images are formed) which are conveyed by the conveyor unit 10 can be stacked on the paper discharge tray 25.

The image forming apparatus 100 also includes a cleaning device 40 as a cleaner for cleaning the intermediate transfer body 37. As shown in FIG. 1, the cleaning device 40 is disposed at a left side of the intermediate transfer body 37, while the cleaning device 40 is facing the intermediate transfer body 37. The image forming apparatus 100 also includes a coating device 73 as a coater that coats the intermediate transfer body 37 (as a recording medium) with a process liquid. As shown in FIG. 1, the coating device 73 is disposed above the intermediate transfer body 37, while facing the intermediate transfer body. The coating device 73 applies the process liquid of predetermined composition, which is in a predetermined state, to the intermediate transfer body 37.

The image forming apparatus 100 also includes a carriage 62. The carriage 62 is a head support member which integrally supports the heads 61Y, 61M, 61C, 61BK, and 61T. The image forming apparatus 100 also includes a controller 98. The controller 98 controls overall operations of the image forming apparatus 100. The controller 98 includes a CPU (not shown), a memory (not shown), and the like. The image forming apparatus 100 also includes an environment detection sensor 35. The environment detection sensor 35 detects an environmental temperature and an environmental humidity of the environment where the image formation is performed in the image forming apparatus 100. The environment detection sensor 35 inputs the detected environmental temperature and humidity into the controller 98.

A printing unit is formed of the ink discharge devices 60Y, 60M, 60C, 60BK, and 60T; the conveyor unit 10; the cleaning device 40; and a control board (not shown) of the heads 61Y, 61W, 61C, 61BK, and 61T, which is included in the controller 98.

In addition to the intermediate transfer body 37, the conveyor unit 10 includes a transfer device 36. The transfer device 36 is disposed to face the intermediate transfer body 37. When the transfer paper sheet S passes through a transfer portion 31 between the intermediate transfer body 37 and the transfer device 36, the transfer device 36 transfers the primary image which is formed of the recording liquids and which is supported on the peripheral surface of the intermediate transfer body 37 onto the transfer paper sheet S.

The conveyor unit 10 also includes conveyance rollers 32 that convey the transfer paper sheet S which is fed from the paper feed unit 20 to the transfer portion 31. The conveyor unit 10 also includes registration rollers 34. The registration rollers 34 stop the transfer paper sheet S which is conveyed by the conveyance rollers 32 once.

Subsequently, the registration rollers 34 feed the transfer paper sheet S to the transfer portion 31 at predetermined timing, which is described later.

The conveyor unit 10 also includes a guide plate 39. The guide plate 39 guides the transfer paper sheet S which is fed from the paper feed unit 20 to the transfer portion 31. Further, the guide plate 39 guides the transfer paper sheet S which passes through the transfer portion 31 to the paper discharge tray 25. The conveyor unit 10 also includes a motor and the like (not shown) as a driving unit that rotationally drives the intermediate transfer body 37 in the A1 direction.

The registration rollers 34 feed the transfer paper sheet S at the timing at which the image formed on the peripheral surface of the intermediate transfer body 37 reaches the transfer portion 31 in accordance with the rotation of the intermediate transfer body 37 in the A1 direction.

The transfer device 36 includes a transfer roller 38 as a transfer member. The transfer roller 38 nips the transfer paper sheet S between the transfer roller 38 and the intermediate transfer body 37. The transfer roller 38 transfers the image on the peripheral surface of the intermediate transfer body 37 onto the transfer paper sheet S, by being rotationally driven by the intermediate transfer body 37, while nipping the transfer paper sheet S. The transfer device 36 also includes an approaching/separating device 77 as a unit that causes the transfer roller 38 to approach the intermediate transfer body 37 and that causes the transfer roller 38 to be separated from the intermediate transfer body 37. The transfer device 36 also includes a cleaning device 78 as a cleaner for cleaning the transfer roller 38.

From a perspective of preventing a stain by the recording liquid and/or the processing liquid, a water repellent member having low surface energy can be disposed on the surface of the transfer roller 38. The transfer roller 38 includes a surface layer on its surface. The surface layer is formed of a fluorine-based resin, a rubber material, a resin, a metal, or a rubber. A fluorine treatment is applied to the surface of the surface layer. Here, examples of the fluorine-based resin include a tetrafluoroethylene resin and a tetrafluoroethylene-perfluoro alkoxy ethylene copolymer. Examples of the rubber material include a fluorosilicone rubber, a phenyl silicone rubber, a fluororubber, a chloroprene rubber, a nitrile rubber, a nitrile butadiene rubber, and an isoprene rubber.

The physical properties of the transfer roller 38 as a surface member are such that, for the water-repellent property, a receding contact angle of water is greater than or equal to 60 degrees, and the hardness is greater than or equal to 60 (JIS-A). It is preferable that the receding contact angle of water be greater than or equal to 80 degrees, and that the hardness be greater than or equal to 80 (JIS-A). Further, the thickness of the surface layer is preferably in a range from 0.1 mm to 1.0 mm. It is more preferable that the thickness be in a range from 0.2 mm to 0.6 mm.

The approaching/separating device 77 shifts the transfer roller 38 toward the intermediate transfer body 37 at timing at which a front end of the transfer paper sheet S, which is fed by the registration rollers 34 toward the transfer portion 31, enters the transfer portion 31, thereby nipping the transfer paper sheet S between the intermediate transfer body 37 and the transfer roller 38. In a nipping state where the transfer paper sheet S is nipped between the intermediate transfer body 37 and the transfer roller 38, the transfer roller 38 is pressed toward the intermediate transfer body 37. In the nipping state, the transfer paper sheet S is pressed toward the intermediate transfer body 37 by the transfer roller 38. In this manner, in the nipping state, the transfer roller 38 functions as a pressure roller (as a pressure member).

The approaching/separating device 77 shifts the transfer roller 38, so that the transfer roller 38 is separated from the intermediate transfer roller 37 at timing at which a tail end of the transfer paper sheet S, which is nipped between the intermediate transfer body 37 and the transfer roller 38, and which is conveyed in the transfer portion 31 by the rotation of the intermediate transfer body 37, passes through the transfer portion 31.

The driving of the transfer roller 38 at these timings by the approaching/separating device 77 is controlled by the controller 98. In this regard, the controller 98 functions as a transfer controlling unit. By the control of the controller 98, which functions as the transfer controlling unit, the transfer roller 38 is prevented from directly contacting the intermediate transfer body 37. In this manner, the process liquid and/or the recording liquids on the peripheral surface of the intermediate transfer body 37 are prevented from being adhered to the transfer roller 38.

The cleaning device 78 cleans the transfer roller 38 by removing paper dust, which is adhered to the transfer roller when the transfer roller 38 contacts the transfer paper sheet S, and the process liquid and/or the recording liquid, which are transferred from the intermediate transfer body 37 to the transfer roller 38 because of some cause. The cleaning device 78 is fixed to a constant position. However, the cleaning device 78 may be movable such that it is shifted together with the transfer roller 38 by the approaching/separating device 77.

The cleaning device 78 may be omitted, provided that the paper dust and the adhesion of the process liquid and/or the recording liquids from the intermediate transfer body 37 to the transfer roller 38 do not cause the transfer paper sheet S to be dirtied or curled, or provided that such effect is negligible. The approaching/separating device 77 may be omitted, provided that the adhesion of the process liquid and/or the recording liquids to the transfer roller 38 does not cause the transfer paper sheet S to be dirtied or curled, or provided that such effect is negligible. However, when the approaching/separating device 77 is omitted, it is possible that large amounts of the process liquid and/or the recording liquids on the intermediate transfer body 37 are adhered to the transfer roller 38. Accordingly, in this case, it is preferable that the cleaning device 78 be included.

In this manner, the transfer device 36 is included in the image forming apparatus 100 (in the conveyor unit 10) as a transfer/recording unit that transfers and records an image on the intermediate transfer body 37 onto the transfer paper sheet S. The transfer device 36 may include a driving source, such as a motor, that drives the transfer roller 38, so that the transfer roller 38 rotates at a position facing the intermediate transfer body 37 in a direction which is the same as the direction A1. The controller 98, which functions as the transfer controlling unit, controls elements whose driving is controlled in the transfer device 36, such as the above-described driving source, in addition to the approaching/separating device 77. As described above, the image forming apparatus 100 is an image forming apparatus based on an indirect transfer method in which an image is indirectly formed on the transfer paper sheet S by using the intermediate transfer body 37.

The intermediate transfer body 37 includes a support 37*a*, and a surface layer 37*b*. The support 37*a* is formed of aluminum. The surface layer 37*b* is formed on the support 37*a*. The surface layer 37*b* is formed of a silicone rubber. The material of the support 37*a* is not limited to aluminum. It suffices if the material has mechanical strength. For example, the support 37*a* may be formed of a metal, an alloy, or the like. Specifically, the support 37*a* may be formed of nickel, a nickel base alloy, a thermoset resin, or ceramics, for example.

The material of the surface layer 37*b* is not limited to the silicone rubber. The material may be an elastic material having low surface energy and high followability with respect to the transfer paper sheet. Such an elastic material is preferable in a point that detachability with respect to the recording liquid is high. The elasticity of the surface layer 37*b* may be required for transferring an image. When the surface layer 37*b* is deformed along fibers of the transfer paper sheet S, a contact area is enlarged, thereby achieving a high transfer ratio. In order to transfer an image with low pressure, it may be necessary to select a material which is soft to some extent, as the material of the surface layer 37*b*. The material of the surface layer 37*b* is not limited to the silicone rubber. For example, the surface layer 37*b* may be formed of a fluorosilicone rubber, a phenyl silicone rubber, a fluororubber, a chloroprene rubber, a nitrile rubber, a nitrile butadiene rubber, or an isoprene rubber. A thickness of the surface layer may be in a range from 0.1 mm to 1 mm. It is preferable that the thickness be in a range from 0.2 mm to 0.6 mm.

The paper feed unit 20 includes a paper feed tray 21, and a paper feed roller 22. Many transfer paper sheets S can be stacked on the paper feed tray 21. The paper feed roller 22 is a sending-out roller that only feeds the top most transfer paper sheet S toward the conveyor unit 10 among the transfer paper sheets S which are stacked on the paper feed tray 21. The paper feed unit 20 further includes a housing 23. The housing 23 supports the paper feed tray 21 and the paper feed roller 22. Further, the paper feed unit 20 includes a motor or the like (not shown), which is a driving unit that rotationally drives the paper feed roller 22. The paper feed roller 22 is rotationally driven so as to be synchronized with the timings of discharging the recording liquids from the corresponding heads 61Y, 61M, 61C, 61BK, and 61T.

The cleaning device 40 is for removing the residual recording liquids on the peripheral surface of the intermediate transfer body 37, namely, on a primary image forming surface, subsequent to transferring the recording liquids onto the transfer paper sheet S. The cleaning device 40 cleans the intermediate transfer body 37 by removing the residual recording liquids. The cleaning device 40 faces the intermediate transfer body 37 at a downstream side of the transfer portion 31 in the A1 direction. Here, the downstream side of the transfer portion 31 is an upstream side, in the A1 direction, of a position where the coating device 73 faces the intermediate transfer body 37 and applies the process liquid onto the peripheral surface of the intermediate transfer body 37. At this position, the cleaning device 40 cleans the intermediate transfer body 37.

The cleaning device 40 includes a cleaning blade (not shown) as an insulating cleaning member which contacts the intermediate transfer body 37 and which removes the recording liquids from the intermediate transfer body 37. It suffices if the cleaning blade has a function to remove the recording liquid on the peripheral surface of the intermediate transfer body 37 by a tip portion of the cleaning blade contacting the peripheral surface of the intermediate transfer body 37. The cleaning blade has abrasion resistance.

The coating device 73 functions as a process liquid coating unit that coats the intermediate transfer body 37 with the process liquid, while contacting the intermediate transfer body 37. The coating device 73 faces the intermediate transfer body 37 at a downstream side in the A1 direction of the position where the cleaning device 40 cleans the intermediate transfer body 37. Here, the downstream side is an upstream side in the A1 direction of the position where the heads 61Y, 61M, 61C, 61BK, and 61T discharge the recording liquids. The coating device 73 coats the intermediate transfer body 37 with the process liquid at this position.

The coating device 73 includes a coating roller 74. The coating roller is a process liquid coating member which contacts the intermediate transfer body 37 at the above-described position and coats the intermediate transfer body 37 with the process liquid. The coating device 73 also includes a process liquid tank 75. The process liquid tank 75 is a process liquid supply unit (a process liquid supply member) that stores the process liquid and that supplies the stored process liquid to the coating roller 74. The coating device 73 also includes a coating amount adjusting device 76. The coating amount adjusting device 76 is a process liquid coating amount adjusting unit that shifts the position of the coating roller 74 relative to the intermediate transfer body 37, so as to adjust a coating amount of the process liquid applied by the coating roller 74 to the intermediate transfer body 37.

At least, a peripheral surface of the coating roller 74 is formed of an elastic material. A portion of the coating roller 74 is dipped in the process liquid, which is stored in the process liquid tank 75. The coating roller 74 contacts the intermediate transfer body 37. Here, the width of the coating roller 74 which contacts the intermediate transfer body 37 corresponds to the image formable area in the main scanning direction, which is the direction perpendicular to the paper surface of FIG. 1.

The coating amount adjusting device 76 adjusts the position of the coating roller 74 relative to the intermediate transfer body 37, while maintaining the state in which the coating roller 74 contacts the intermediate transfer body 37. In this manner, the coating amount adjusting device 76 varies a pressing force of the coating roller 74 toward the intermediate transfer body 37. When the position of the coating roller 74 is adjusted, the amount of the process liquid, which adheres to the surface of the coating roller 74 and is subsequently transferred onto the intermediate transfer body 37, varies. Specifically, when the position of the coating roller 74 is close to the intermediate transfer body 37, and when the pressing force of the coating roller 74 toward the intermediate transfer body 37 is strong, the coating amount of the process liquid is increased.

The position of the coating roller 74 relative to the intermediate transfer body 37, namely, the gap between the intermediate transfer body 37 and the coating roller 74, is controlled by the controller 98. In other words, the driving of the coating amount adjusting device 76 for adjusting the coating amount of the process liquid to the intermediate transfer body 37 is controlled by the controller 98. In this regard, the controller 98 functions as a process liquid coating control unit for controlling the coating device 73. Especially, the controller 98 functions as a process liquid amount control unit, which is a gap control unit. The controller 98, which functions as the process liquid amount control unit, drives the coating amount adjusting device 76 based on the environmental temperature and the environmental humidity, which are detected by the environment detection sensor 35, and thereby the controller 98 controls the amount of the process liquid applied to the intermediate transfer body 37.

In order to do this, the controller 98, which functions as the process liquid amount control unit, stores, in advance, a table which indicates correspondence between the amount of the process liquid and the environmental temperature and humidity. Here, the environmental temperature and humidity are detected by the environment detection sensor 35. The controller 98 drives the coating amount adjusting device 76 in accordance with the table. The table stores information such that, when the environmental temperature is high and the environmental humidity is high, namely, when the environment is such that phase inversion reaction tends to occur, the gap between the intermediate transfer body 37 and the coating roller 74 is to be reduced, so as to reduce the coating amount of the process liquid. A phase inversion condition can be changed from W/O emulsion to O/W emulsion, depending on the external environment. By controlling the coating amount of the process liquid in this manner, even if the phase inversion condition is changed, the phase inversion reaction is ensured, thereby obtaining the advantages described later.

If the environmental temperature and the environmental humidity do not affect the phase inversion reaction, which is described later, or if such an effect is negligible, the coating amount adjusting device 76 may be omitted. When the coating amount adjusting device 76 is omitted, the environment detection sensor 35 and the function of the controller as the process liquid amount control unit may also be omitted.

If one of the environmental temperature and the environmental humidity does not affect the phase inversion reaction, or if such an effect is negligible, it is preferable to omit a sensor that detects the one of the environmental temperature and the environmental humidity, and to include an environment detection sensor which detects the other one. In this case, if the environmental temperature is to be detected, the environment detection sensor is included as a temperature detection sensor. If the environmental humidity is to be detected, the environmental detection sensor is included as a humidity detection sensor. Further, the controller 98, which functions as the process liquid amount control unit, stores a table of one of the environmental temperature and the environmental humidity, which is to be detected. The environmental temperature tends to affect the phase inversion reaction, compared to the environmental humidity. Thus, it is preferable that the environment sensor at least includes a function as an environmental temperature sensor.

The process liquid tank 75 is fixed at a constant position. However, the process liquid tank 75 may be moved together with the coating roller 74 by the coating amount adjusting device 76. The coating device 73 may include a driving source, such as a motor, so that the coating roller 74 rotates in a direction which is the same as the A1 direction at a position at which the coating roller 74 faces the intermediate transfer roller 37. The controller 98, which functions as the process liquid coating control unit, controls elements whose driving is controlled in the coating device 73, such as the above-described driving source, in addition to the coating amount adjusting device 76. The process liquid coating member is not limited to a roller-shaped member which applies the process liquid with the roller, such as the coating roller 74, provided that the process liquid coating member applies the process liquid, while contacting the intermediate transfer body 37. For example, the process liquid coating member may be a wire bar, a blade coater, or a foam body in which the process liquid is percolated.

Hereinafter, there is explained the process liquid which is applied to the intermediate transfer body 37 by the coating device 73. Additionally, there is explained a water-soluble polymer which is included in the process liquid. The water-soluble polymer is dispersed in the process liquid. A base of such a process liquid is a low polarity solvent, which is not compatible with water, namely, whose phase is separated from the water phase at room temperature. The process liquid is a resultant of emulsifying, by using a surfactant, water, which includes at least the water-soluble polymer, and the low polarity solvent, which is not compatible with water. Namely, the process liquid is in a phase such that, in a state in which the water-soluble polymer is dissolved in the low polarity solvent by using the surfactant, the water phase including the water-soluble polymer is dispersed to form W/O emulsion. Here, such a surfactant is referred to as a "first surfactant."

Figure 2B:
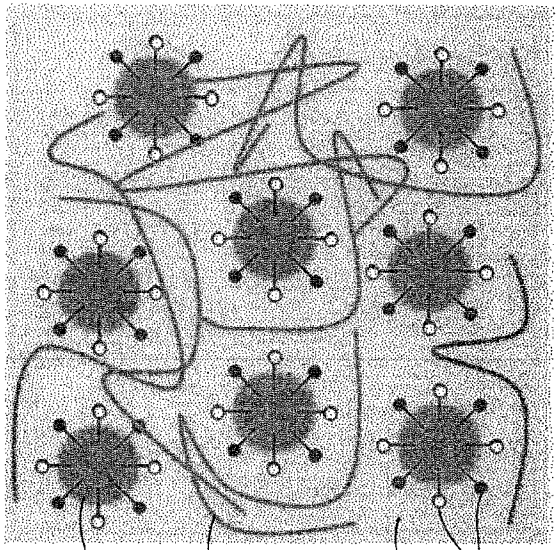
FIG. 2B is a schematic diagram of an O/W emulsion.
Figure 2A:
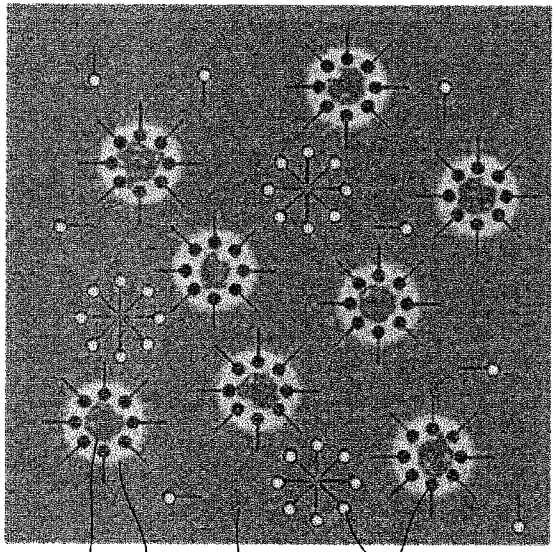
FIG. 2A is a schematic diagram of a W/O emulsion.

As shown in FIG. 2A, in this phase, the water 92 including the water-soluble polymer 91 becomes water drops. The water 92 is in a dispersed phase. The low polarity solvent 93 is in a continuous phase. In this manner, an aqueous solution, which is formed of the water 92 in which the water-soluble polymer 91 is dissolved, is dispersed by using the low polarity solvent 93.

As shown in FIG. 2A, a state in which water drops are dispersed in an oil phase which is formed of the low polarity solvent 93 is referred to as a "W/O emulsion." Whereas, as shown in FIG. 2B, a state in which oil droplets, which are formed of the low polarity solvent 93, are emulsified in a water phase, which is formed of the water 92, is referred to as an "O/W emulsion."

In the image forming apparatus 100, as the recording liquids, water-based recording liquids are utilized, and the recording liquids are discharged from the corresponding heads 61Y, 61M, 61C, 61BK, and 61T. Then the discharge recording liquids contact the process liquid, and they are mixed. By this contact, the phase of the W/O emulsion, which is shown in FIG. 2A, is inverted into the phase of the O/W emulsion, which is shown in FIG. 20. In the state of the W/O emulsion, the water-soluble polymer is included within the water drop. However, when the phase is inverted into the O/W emulsion, the water-soluble polymer is dispersed into the water phase, and the water-soluble polymer demonstrates a thickening effect. In a state prior to the phase inversion, the water-soluble polymer is included within the water drops in the state of the W/O emulsion. Thus, in the state of the W/O emulsion, the viscosity of the process liquid is suppressed.

The water-soluble polymer which is dispersed in the water phase causes colored components in the water 92 (the water phase) and the recording liquids to be thickened and condensed. In this manner, when the recording liquids are transferred onto the recording paper sheet S, the water-soluble polymer functions to prevent the colored components in the recording liquids from being blurred on the transfer paper sheet S. Thus, a high-definition (high resolution) image can be formed where the bleeding and feathering are prevented, while the transfer paper sheet S is prevented from being curled and waved.

As a specific example of low polarity solvent, paraffinic hydrocarbon; naphthenic hydrocarbon; olefinic hydrocarbon; acetylenic hydrocarbon; a vegetable oil such as olive oil, palm oil, canola oil, or sesame oil; or an animal oil such as beef tallow may be considered.

The water-soluble polymer which is used for the process liquid is not particularly limited. However, when an ionic colorant and/or an ionic resin (described later) are/is anionic, it is preferable that the water-soluble polymer, which is used for the process liquid, be cationic. Further, when the ionic colorant and/or the ionic resin are/is cationic, it is preferable that the water-soluble polymer, which is used for the process liquid, be anionic. The water-soluble polymer which is used for the process liquid may be nonionic.

The cationic water-soluble polymer is not particularly limited, provided the cationic water-soluble polymer includes a cationic group. As a specific example of cationic water-soluble polymer, polyvinylamine and its salt; polyvinylamine and its salt; polyethyleneimine and its salt; polyacrylamide and its salt; a cationic epoxy; a cationic emulsion; allylamine-maleic acid copolymer; a polydimethylmethylenepiperidium chloride and its salt; dimethyldiallylammonium chloride-acrylamide copolymer and its salt; vinylpyrrolidone; N-dimethylaminoethyl-methacrylic acid copolymer and its salt; N-vinylpyrrolidone; N-dimethylaminoethyl-methacrylic acid copolymer and its salt; special modified poly acrylic acid ester and its salt; polyacrylic ester and its salt; polymethacrylic acid ester and its salt; polydicyandiamide and its salt; or polyamine condensate and its salt may be considered.

An anionic water-soluble copolymer is not particularly limited, provided that the anionic water-soluble copolymer includes an anionic group. As a specific example of the anionic water-soluble copolymer, sodium polyacrylate may be considered.

A nonionic water-soluble polymer is not particularly limited. As a specific example of the nonionic water-soluble polymer, polyacrylamide may be considered.

In order to emulsify the water, in which the water-soluble polymer is dissolved, into the low polarity solvent, a highly lipophilic surfactant is preferably utilized. As an example of the highly lipophilic surfactant, glycerine fatty acid ester, sorbitan fatty acid ester, or polyethylene glycol fatty acid ester may be considered.

When the recording liquids contact the process liquid and the recording liquids are mixed with the process liquid, it is preferable to add the highly lipophilic surfactant to a mixture liquid of the process liquid and the recording liquid, so that a dispersed state of the water-soluble polymer in the mixture liquid is changed. Specifically, such a change of the dispersed state is a phase inversion such that the dispersed state (the emulsified state) of the water-soluble polymer in the mixture liquid is changed from the W/O emulsion to the O/W emulsion.

It suffices if the highly lipophilic surfactant is added to at least one of the recording liquids and the process liquid. Since the dispersed state is efficiently changed when the recording liquids and the process liquid are mixed, such addition of the highly lipophilic surfactant to the one of the recording liquids and the process liquid is preferable. For such a surfactant, it is desirable to use a surfactant having a Hydrophile-Lipophile Balance value (HLB value) of 8 or more. However, when the HLB value is too large, bubbles tend to be generated in the recording liquids in the heads. Thus, it is more desirable to use a surfactant whose HLB value is in a range from 8 to 15. As an example of the surfactant which satisfies condition on the HLB value, polyoxyethylene lauryl ether may be considered.

Here, the surfactant which is added to the one of the recording liquids and the process liquid is referred to as a "second surfactant." It is known that the surfactant may not be required for the phase inversion from the W/O emulsion to the O/W emulsion, which is caused by the contact between the water-based recording liquids and the process liquid. Namely, it is known that there is a case in which the addition of the second surfactant is not required for the phase inversion from the W/O emulsion to the O/W emulsion.

The carriage 62 is detachably attached to the main body 99. Here, the carriage 62 can be attached to and detached from the main body 99 together with the heads 61Y, 61M, 61C, 61BK, and 61T. That is because, when the heads 61Y, 61M, 61C, 61BK, and 61T are deteriorated, they can be easily replaced with new ones. Further, with such a configuration, it is easier to perform maintenance. The heads 61Y, 61M, 61C, 61BK, and 61T are independently detachably attached to the in body 99. That is because, when one of the heads 61Y, 61W, 61C, 61BK, and 61T is deteriorated, the one of the heads can be easily replaced with new one. With such a configuration, it is much easier to perform the maintenance. In this manner, the exchanging operation and the maintenance work are facilitated.

Although the colors and the compositions of the recording liquids used for the ink discharge devices 60Y, 60M, 60C, 60BK, and 60T are different, the ink discharge devices 60Y, 60M, 60C, 60BK, and 60T are substantially the same in the other points. In the ink discharge devices 60Y, 60M, 60C, 60BK, and 60T, the corresponding pluralities of heads 61Y, 61M, 61C, 61BK, and 61T are arranged in parallel in the main scanning direction. Thus, the ink discharge devices 60Y, 60M, 60C, 60BK, and 60T are full-line type ink discharge devices. The image forming apparatus 100 is a full-line type apparatus.

The ink discharge devices 60Y, 60W, 60C, 60BK, and 60T include ink cartridges 81Y, 81M, 81C, 81BK, and 81T. The ink cartridges 81Y, 81M, 81C, 81BK, and 81T store corresponding colors of ink, which are supplied to the corresponding heads 61Y, 61M, 61C, 61BK, and 61T. The ink discharge devices 60Y, 60M, 60C, 60BK, and 60T also include supply pumps (not shown) which compress and circulate (supply) the recording liquids to the corresponding heads 61Y, 61M, 61C, 61BK, and 61T. The ink discharge devices 60Y, 60M, 60C, 60BK, and 60T include sub-tanks (not shown) for distributing and supplying the recording liquids, which are supplied by the pumps, to the corresponding heads 61Y, 61M, 61C, 61BK, and 61T.

The ink discharge devices 60Y, 60M, 60C, 60BK, and 60T include ink amount detection sensors (not shown) as ink amount detection units (recording liquid detection units) for detecting amounts of the corresponding recording liquids. The ink amount detection sensors are for detecting shortage of the corresponding recording liquid in the sub-tanks. The ink discharge devices 60Y, 60M, 60C, 60BK, and 60T also include corresponding pipes (not shown). The pipes form supply paths of the corresponding recording liquids between the sub-tanks and the corresponding ink cartridges 81Y, 81M, 81C, 81BK, and 81T, together with the corresponding pumps. Further, the ink discharge devices 60Y, 60M, 60C, 60BK, and 60T also include corresponding pipes (not shown). The pipes form supply paths of the corresponding liquids between the sub-tanks and the corresponding heads 61Y, 61M, 61C, 61BK, and 61T.

The ink cartridges 81Y, 81M, 81C, 81BK, and 81T are detachably attached to the main body 99, so that each of the ink cartridges 81Y, 81M, 81C, 81BK, and 81T can be replaced with a new one, when a remaining amount of the corresponding recording liquid becomes small, or when the corresponding recording liquid runs out. Here, the ink cartridges 81Y, 81M, 81C, 81BK, and 81T are detachable so as also to facilitate the maintenance. The ink cartridges 81Y, 81M, 81C, 81BK, and 81T function as main tanks (recording liquid cartridges).

Operations of the corresponding pumps are controlled by the controller 98. The pumps supply the recording liquids which are stored in the ink cartridges 81Y, 81M, 81C, 81BK, and 81T to the corresponding heads 61Y, 61M, 61C, 61BK, and 61T. Specifically, the pumps are driven when the head 61Y, 61M, 61C, 61BK, and 61T stop discharging the corresponding recording liquids, provided that the ink amount detection sensors detect the shortage of the corresponding recording liquids in the sub-tanks. By the driving of the pumps, the recording liquids in the corresponding ink cartridges 81Y, 81M, 81C, 81BK, and 81T are supplied to the sub-tanks (distributors) as the ink supply units (the recording liquid supply units). The driving is continued until the shortage is not detected. In this respect, the controller 98 functions as an ink supply control unit (a recording liquid supply control unit). The controller 98 controls driving of a component which is driven in the image forming apparatus 100, even if the driving of the component is not specifically explained.

Each of the heads 61Y, 61M, 61C, 61BK, and 61T includes a nozzle plate and an infinitesimal nozzle which is formed in the nozzle plate at a side facing the intermediate transfer body 37, at which the recording liquid is discharged (the nozzle plate and the infinitesimal nozzle are not shown in the figure).

Each or the heads 61Y, 61M, 61C, 61BK, and 61T includes a piezo-type movable actuator (not shown). The piezo-type movable actuator is driven so as to discharge the recording liquid, which is in the form of liquid droplets, from the nozzle, and so as to cause the liquid droplets to be adhered onto the intermediate transfer body 37, based on an image signal. The movable actuator applies pressure to the recording liquid inside a liquid chamber by deformation of piezoelectric material, and thereby the movable actuator causes the recording liquid to be discharged from the nozzle. Here, the movable actuator may be a movable actuator other than the piezo-type. For example, for each of the heads 61Y, 61M, 61C, 61BK, and 61T, a heating-film boiling method such as a thermal method may be utilized. In the thermal method, the pressure is applied to the recording liquid in the liquid chamber by bubbles which are generated by heater heating, and thereby the recording liquid is discharged from the nozzle.

The heads 61Y, 61M, 61C, 61BK, and 61T are driven depending on the image signal, and the heads 61Y, 61M, 61C, 61BK, and 61T apply the corresponding recording liquids onto the transfer paper sheet S through the intermediate transfer body 37. A plurality of nozzles is formed in each of the heads 61Y, 61M, 61C, 61BK, and 61T.

Hereinafter, the recording liquids which are discharged from the corresponding heads 61Y, 61M, 61C, 61BK, and 61T are explained. Each of the recording liquids which is discharged from the corresponding one of the heads 61Y, 61M, 61C, 61BK, and 61T is a water-based recording liquid. A solvent of the water-based recording liquid is water. Here, the recording liquids which are discharged from the heads 61Y, 61M, 61C, and 61BK include corresponding colorants. However, the recording liquid which is discharged from the head 61T does not include any colorant. The heads 61Y, 61M, 61C, 61BK function as a first head that discharges the water-based recording liquids which include the corresponding colorants. The head 61T functions as a second head that discharges a water-based recording liquid which does not include any colorant.

As examples of colorants (coloring materials) of the recording liquids corresponding to yellow, magenta, cyan, and black, anionic dyes; cationic dyes; pigments which are dispersed using anionic dispersants or cationic dispersants, or coloring emulsions may be considered.

As a specific example of the anionic dye, a dye can be considered which is categorized as an acid dye, a food dye, a direct dye, or a reactive dye in the color index. More specifically, as examples of the acid dye and the food dye, C.I.Acid Yellow 17, 23, 42, 44, 79, and 142; C.I.Acid Red 1, 8, 13, 14, 18, 26, 27, 35, 37, 42, 52, 82, 87, 89, 92, 97, 106, 111, 114, 115, 134, 186, 249, 254, and 289; C.I.Acid Blue 9, 29, 45, 92, 249; C.I.Acid Black 1, 2, 7, 24, 26, and 94; C.I.Food Yellow 3, and 4; C.I.Food Red 7, 9, and 14; and C. I. Food Black 1, and 2 may be considered.

Further, as examples of the direct dye, C.I.Direct Yellow 1, 12, 24, 26, 33, 44, 50, 86, 120, 132, 142, and 144; C.I.Direct Red 1, 4, 9, 13, 17, 20, 28, 31, 39, 80, 81, 83, 89, 225, and 227; C.I.Direct Orange 26, 29, 62, and 102; C.I.Direct Blue 1, 2, 6, 15, 22, 25, 71, 76, 79, 86, 87, 90, 98, 163, 165, 199, and 202; and C.I.Direct Black 19, 22, 32, 38, 51, 56, 71, 74, 75, 77, 154, 168, and 171 may be considered.

As examples of the reactive dye, C.I.Reactive Black 3, 4, 7, 11, 12, and 17; C.I.Reactive Yellow 1, 5, 11, 13, 14, 20, 21, 22, 25, 40, 47, 51, 55, 65, and 67; C.I.Reactive Red 1, 14, 17, 25, 26, 32, 37, 44, 46, 55, 60, 66, 74, 79, 96, and 97; and C.I.Reactive Blue 1, 2, 7, 14, 15, 23, 32, 35, 38, 41, 63, 80, and 95 may be considered. It is preferable to utilize the reactive dye, because of the high water solubility, a good color tone, and good water resistance when the recording is performed by using the method of the image forming apparatus 100, namely, the recording is performed by using the above-described phase inversion.

It is preferable that the anionic dye is such that three or more carboxyl groups and three or more sulfonic acid groups are included in one molecule. When one molecule of the anionic dye includes three or more carboxyl groups and three or more sulfonic acid groups, the anionic dye is highly reactive with the water-soluble polymer in the process liquid. When an image is transferred onto the transfer paper sheet S, and when the anionic dye reacts with the water-soluble polymer, the blurring of the image is prevented from occurring by the thickening effect and the condensation effect. Further, when one molecule of the anionic dye includes three or more carboxyl groups and three or more sulfonic acid groups, the preservation stability and anti-clogging property of the recording liquids are ensured. Thus, it is preferable that one molecule of the anionic dye includes three or more carboxyl groups and three or more sulfonic acid groups.

As an example of the cationic dye, a basic dye or a cation dye may be considered. More specifically, as examples of the basic dye, C.I.Basic Blue 9, 12, and 26; C.I.Basic Red 2, 5, and 9; and C.I.Basic Black 2 may be considered. Further, as examples of the cation dye, G.Yellow GL 200, Red BL 200 R-46, and Blue GRL-NB41 may be considered.

As examples of the pigment which is used as the colorant of the recording liquid, an inorganic pigment, or an organic pigment may be considered. As examples of the inorganic pigment, a white pigment such as titanium oxide, zinc oxide, barium sulphate; and a black pigment such as iron oxide may be considered. As examples of the organic pigment, an azo pigment (e.g., azo lake, an insoluble azo pigment, a condensation azo pigment, and a chelate azo pigment); a polycyclic pigment (e.g., a phthalocyanine pigment, a perylene pigment, a perinone pigment, an anthraquinone pigment, a quinacridone pigment, a dioxazine pigment, a thioindigo pigment, an isoindolinone pigment, and a quinophthalone pigment); a dye chelate (e.g., a basic dye chelate, and an acid dye chelate); a nitro pigment; a nitroso pigment; and aniline black are considered.

Further, a colorant such as carbon black which is produced by a known method, such as a contact process, a furnace method, or a thermal method may be used as a pigment. To be more specific, for the color recording liquids, C.I.Pigment Yellow 1 (Fast Yellow G), 3, 12 (Diazo Yellow AAA), 13, 14, 17, 24, 34, 35, 37, 42 (Yellow Iron Oxide), 53, 55, 81, 83 (Disazo Yellow HR), 95, 97, 98, 100, 101, 104, 108, 109, 110, 117, 120, 133, and 153; C.I.Pigment Orange 5, 13, 16, 17, 36, 43, and 51; C.I.Pigment Red 1, 2, 3, 5, 17, 22 (Brilliant Fast Scarlet), 23, 31, 38, 48:1 (Permanent Red 2B (Ba)), 48:2 (Permanent Red 2B (Ca)), 48:3 (Permanent Red 2B (Sr)), 48:4 (Permanent Red 2B (Mn)), 49:1, 52:2, 53:1, 57:1 (Brilliant Carmine 6B), 60:1, 63:1, 63:2, 64:1, 81 (Rhodamine 6G Lake), 83, 88, 101 (Red Iron Oxide), 104, 105, 106, 108 (Cadmium Red), 112, 114, 122 (Quinacridone Magenta), 123, 146, 149, 166, 168, 170, 172, 177, 178, 179, 185, 190, 193, 209, and 219; C.I.Pigment Violet 1 (Rhodamine Lake), 3, 5:1, 16, 19, 23, and 38; C.I.Pigment Blue 1, 2, 15 (Phthalocyanine Blue R), 15:1, 15:2, 15:3 (Phthalocyanine Blue E), 16, 17:1, 56, 60, and 63; and C.I.Pigment Green 1, 4, 7, 8, 10, 17, 18, and 36 may be considered.

For a case where a recording liquid including a pigment is utilized as a colorant, a pigment is preferably used in which an ionic group, especially, a carboxylic group is covalently bonded. For example, carbon black in which a carboxylic group is introduced by an oxidizing reaction; a self-dispersing pigment which is formed by reacting a radical which is generated from a diazonium salt including a carboxyl group or a sulfonic acid group with a pigment such as carbon black, phthalocyanine, or quinacridone; a self-dispersing pigment which is formed by reacting a radical initiator including a carboxyl group or a sulfonic acid group with a pigment such as carbon black, phthalocyanine, or quinacridone; or a self-dispersing pigment which is formed by reacting a functional group of a pigment with a carboxylic acid anhydride may be used.

The dispersion states of these pigments are very stable in a liquid medium which mainly includes water. Thus, these pigments are excellent in preserving stability and the anti-clogging property. In addition, these pigments are highly reactive with the water-soluble polymer in the process liquid. These pigments greatly prevent occurrence of color mixture by the thickening effect and the condensation effect, which are caused by the reaction with the water-soluble polymer.

When a pigment is utilized as a colorant, the pigment is dispersed by an anionic polymer dispersant or a cationic polymer dispersant. Examples of a polymer dispersant having an anionic group include polyacrylic acid and its salt; polymethacrylic acid and its salt; acrylic acid-acrylonitrile copolymer and its salt; acrylic acid-acrylic acid alkyl ester copolymer and its salt; styrene-acrylic acid copolymer and its salt; styrene-methacrylic acid copolymer and its salt; styrene-acrylic acid-acrylic acid alkyl ester copolymer and its salt; styrene-methacrylic acid-acrylic acid alkyl ester copolymer and its salt; styrene-α-methyl styrene-acrylic acid copolymer and its salt; styrene-α-methyl styrene-acrylic acid copolymer-alkyl acrylate copolymer and its salt; styrene-maleic acid copolymer and its salt; vinyl naphthalene-maleic acid copolymer and its salt; vinyl acetate-ethylene copolymer and its salt; vinyl acetate-crotonic acid copolymer and its salt; vinyl acetate-acrylic acid copolymer and its salt; and β naphthalene sulfonic acid formalin condensate.

These high molecular compounds having anionic groups may be used as acid. However, an alkali metal salt may be added such as a salt of sodium, potassium, or lithium. These anionic polymers are especially preferable in a point that they demonstrate a significant effect of preventing occurrence of the color mixture by reacting with the water-soluble polymer in the process liquid. Further, these anionic polymers have adhesive functions for adhering the colorant. Accordingly, these anionic polymers have advantages such that, in the transferring process, the transfer ratio of transferring an image from the intermediate transfer body 37 onto the transfer paper sheet S is increased. As an example of a polymer dispersant having a cationic group, an alkylamine salt is considered.

An anionic surfactant is preferably used as a pigment dispersant. Specific examples of the dispersant which disperses the pigment include a fatty acid and its salt, such as an oleic acid and its salt, a lauric acid and its salt, a behenic acid and its salt, and a stearic acid and its salt; an alkyl sulfonic acid and its salt, such as a dodecyl sulfonic acid and its salt, and a decyl sulfonic acid and its salt; an alkylsulfuric acid ester, such as layrylsulfate, and oleylsulfate; a dihexyl sulfosuccinic acid and its salt, such as a dioctyl sulfosuccinic acid and its salt, and a dihexyl sulfosuccinic acid and its salt; an aromatic anion-based surfactant, such as a naphthyl sulfonic acid and its salt, and a naphtylcarboxylic acid and its salt; and a fluorine-based anionic surfactant, such as a polyoxyethylene alkyl ether acetate, a polyoxyethylene alkyl ether phosphate, a polyoxyethylene alkyl ether sulfonate, a fluorinated alkyl carboxylic acid and its salt, and a fluorinated alkyl sulfonic acid and its salt.

When these surfactants are used as the dispersants of the pigment, it is preferable to use a surfactant including a carboxylic group such as an alkyl carboxylate, an alkylbenzene carboxylate, or a polyoxyethylene alkyl ether acetate. That is because the surfactant including the carboxylic group is highly reactive, and the effect of preventing the color mixture is large.

When a recording liquid, in which a pigment is dispersed, is used, a particle diameter of the pigment is not particularly limited. It is preferable to use pigment ink such that a particle diameter is in a range from 20 nm to 150 nm (i.e., the maximum frequency, which is based on the maximum detection number, is in the range from 20 nm to 150 nm). When the particle diameter is greater than 150 nm, pigment dispersing stability as a recording liquid is lowered. Further, discharging stability of the recording liquid is also lowered, and image quality such as image density is lowered. Accordingly, it is not preferable that the particle diameter be greater than 150 nm. When the particle diameter is less than 20 nm, the preservation stability of the recording liquid is ensured. In addition, the discharging characteristic of the recording liquid from the head is stabilized. Thus, when the process liquid is used, high image quality can be achieved. However, in order to disperse such small particles, a complicated dispersing process and a complicated classification process may be required. Since it is difficult to reduce the cost of producing the recording liquid, it is not preferable that the particle diameter be less than 20 nm.

A "colored emulsion," in which colored resin fine particles are dispersed, is another example of a colorant which can be used for a recording liquid. A colored resin fine particle is a resin (such as a styrene-acrylic resin, a polyester resin, or a polyurethane resin) which is colored with a colorant (such as an oil dye or a disperse dye). By forming a shell portion of the fine particle with a hydrophilic resin, such as a polyacrylic acid, or a polymethacrylic acid, a recording liquid is obtained such that anionic colored fine particles are dispersed in a liquid medium which mainly includes water, for example. A similar recording liquid can be obtained, when the shell portions of the fine particles are dispersed by an ionic surfactant, such as a reactive surfactant.

When a recording liquid is used, for which a colored emulsion is utilized, it is particularly preferable to use a colored emulsion which is emulsified and condensed by the anionic surfactant, or a emulsion which is formed of the resin fine particles. Here, the outer shells of the resin fine particles are formed of a hydrophilic resin, such as a polyacrylic acid or a polymethacrylic acid. That is because such a colored emulsion is highly reactive with the water-soluble polymer in the process liquid, and the effect of preventing the color mixture is large. Such colored resin fine particles have an advantage such that, in the transfer process, the transfer ratio from the intermediate transfer body 37 to the transfer paper sheet S is increased (though it depends on the minimum film forming temperature). If the colored resin fine particles are heated to a temperature which is greater than the minimum film forming temperature, a printed material can be obtained which has a high transfer rate, good brightness, good light stability, good water resistance, and good scratch resistance.

Hereinabove, the recording liquids are explained, in which a dye, a pigment, or a colored emulsion is utilized as a colorant. These colorants are ionic colorants. However, the colored emulsion may be nonionic, for example.

By adding a hydrophilic polymer to the recording liquid, an advantage is obtained such that the thickening effect and the condensing effect of the recording liquid are strengthened by the reaction of the hydrophilic polymer with the water-soluble polymer in the process liquid, and thereby image quality is improved. An ionic resin, which is explained as a hydrophilic polymer below, demonstrates such effects. Since image quality is improved and curling of the transfer paper sheet S is prevented, it is preferable to use the ionic resin. However, the ionic resin is not essential. In some cases, similar advantages can be obtained by using a nonionic resin, instead of the ionic resin.

Examples of the hydrophilic polymer are as follows. Namely, for natural products, polymers derived from a plant, such as gum arabic, gum tragacanth, guar gum, karaya gum, locust bean gum, arabinogalacton, pectin, and quince seed starch; polymers derived from seaweed, such as an alginic acid, carrageenan, and agar; polymers derived from an animal, such as gelatin, casein, albumen, and collagen; polymers derived from microorganisms, such as xanthene gum and dextran; and ceramics may be considered. For semisynthetic materials, fiber-based polymers, such as methylcellulose, ethylcellulose, hydroxyethylcellulose, hydroxypropylcellulose, and carboxymethylcellulose; starch-based polymers, such as sodium carboxymethyl starch, and sodium starch phosphate; and seaweed-based polymers, such as sodium alginate, and propylene glycol alginate may be considered. For pure synthetic materials, vinyl polymers such as polyvinyl alcohol, polyvinylpyrrolidone, and polyvinyl methyl ether; non-cross-linked polyacrylamide, polyacrylic acid, and its alkali metal salt; acrylic resins, such as a water-soluble styrene-acrylic resin; a water-soluble styrene-acrylic resin; a water-soluble styrene-maleic acid resin; a water-soluble vinyl naphthalene-acrylic resin; a water-soluble vinyl naphthalene-maleic acid resin; and an alkali metal salt of β-naphthalene-sulfonic acid formalin condensate may be considered.

When a water-soluble polymer compound is used for the recording liquid, it is preferable to use a water-soluble polymer including a carboxylic acid as an anionic group. In this case, the water-soluble polymer highly reacts with the water-soluble polymer in the process liquid, and the effect of preventing the color mixture is large. Additionally, similar to the above-described anionic polymer and the resin emulsion, an advantage is obtained such that the transfer rate from the intermediate transfer body 37 to the transfer paper sheet S is increased in the transfer process.

It is also preferable that the recording liquid includes a saccharide, especially, a polysaccharide, as a hydrophilic polymer compound which reacts with the water-soluble polymer in the process liquid. Examples of the saccharide compound include an alginic acid and its salt; a uronic acid and its salt; and an aldonic acid and its salt.

It is also preferable to add a resin emulsion and latex, which do not include a colorant, to the recording liquid as components which react with the water-soluble polymer in the process liquid. The resin emulsion strengthens the thickening effect and the condensing effect of the recording liquid by reacting with the water-soluble polymer in the process liquid, thereby improving the image quality. Thus, the resin emulsion is particularly preferable. In addition, depending on the type of the resin emulsion, the resin emulsion forms a film on the intermediate transfer body 37 (which is the recording medium), thereby improving the light resistance, the water resistance, and the scratch resistance of printed material.

Further, similar to the colored emulsion, it is preferable to use a resin which is emulsified and dispersed by an anionic surfactant. It is also preferable to use a resin emulsion having a capsule shape, whose outer shell is formed of an acrylic acid or a methacrylic acid.

As an example of a resin component in a dispersed phase, an acrylic resin, a vinyl acetate resin, a styrene-butadiene resin, a vinyl chloride resin, an acrylic-styrene resin, a butadiene resin, or a styrene-based resin may be considered. Each of these resins is preferable because it is a polymer having a hydrophilic moiety and a hydrophobic moiety. Further, a particle diameter of each of these resins is not particularly limited, provided that the resin component forms the emulsion. However, it is preferable that the particle diameter be approximately less than 150 nm, and it is more preferable that the particle diameter be in a range from 5 to 100 nm.

Examples of commercially available resin emulsions include Microgel E-1002, E5002 (styrene-acrylic resin emulsion, produced by Nippon Paint Co., Ltd.), Voncoat 4001 (acrylic resin emulsion, produced by Dainippon Ink and Chemicals Co., Ltd.), Voncoat 5454 (styrene-acrylic resin emulsion, produced by Dainippon Ink and Chemicals Co., Ltd), SAE-1014 (styrene-acrylic resin emulsion, produced by Zeon Japan Co., Ltd.), and Saibinol SK-200 (acrylic resin emulsion, produced by Saiden Chemical Industry Co., Ltd.).

It is preferable to add the resin emulsion to the recording liquid, so that the resin component be in a range from 0.1% to 40% by mass of the recording liquid, and it is more preferable that the resin component be in a range from 1% to 25% by mass of the recording liquid.

For the recording liquid, water is used as the main liquid solvent. However, in order to maintain a desired physical property of the recording liquid, or in order to prevent clogging of the nozzles of the heads 61Y, 61M, 61C, 61BK, and 61T which is caused by drying of the recording liquid, it is preferable to use a water-soluble organic solvent as a Lubricant.

Specific examples of the water-soluble organic solvent include polyvalent alcohols such as ethylene glycol, diethylene glycol, triethylene glycol, tetraethylene glycol, polyethylene glycol, propylene glycol, 1,3-propanediol, 2-methyl-1,3-propanediol, 1,4-butanediol, 1,5-pentanediol, 1,6-hexanediol, glycerin, 1,2,6-hexanetriol, 2-ethyl-1,3-hexanediol, 1,2,4-butanetriol, 1,2,3-butanetriol, and 3-methyl-1,3,5-pentanetriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether, and propylene glycol monomethyl ether; polyol aryl ethers such as ethylene glycol monophenyl ether, and ethylene glycol monobenzyl ether; nitrogen-containing heterocyclic compounds such as N-methyl-2-pyrrolidone, N-hydroxyethyl-2-pyrrolidone, 2-pyrrolidone, 1,3-dimethyl imidazolidinone, and epsilon-caprolactam; amides such as formamide, N-methylformamide, and N,N-dimethylformamide, amines such as monoethanolamine, diethanolamine, triethanolamine, monoethylamine, diethylamine, and triethylamine; sulfur-containing compounds such as dimethylsulfoxide, sulfolane, and thiodiethanol; propylene carbonate; ethylene carbonate; and γ-butyrolactone.

These solvents may be independently used together with water. Alternatively, some of these solvents are mixed and used together with water. The content of the water-soluble organic solvent is not particularly limited. However, it is preferable that the content of the water-soluble organic solvent be in a range from 1% to 60% by mass of the total of the recording liquid. It is more preferable that the content of the water-soluble organic solvent be in a range from 5% to 30% by mass of the total of the recording liquid.

In addition, the recording liquid may include additives such as a pH adjusting agent, a viscosity modifier, a preservative, and an antioxidant. Examples of the pH adjusting agent include hydroxides of alkali metal elements, such as lithium hydroxide, sodium hydroxide, and potassium hydroxide; ammonium hydroxide; quaternary ammonium hydroxide; quaternary phosphonium hydroxide; carbonates of alkali metal, such as lithium carbonate, sodium carbonate, and potassium carbonate; amines, such as diethanolamine, and triethanolamine; a boric acid; a nitric acid; a sulfuric acid; and an acetic acid.

Suitable ranges of the physical property of the recording liquid are such that, at around 25 degrees Celsius, the pH is in a range from 6 to 12, the surface tension is in a range from 10 mN/m to 60 mN/m, and the viscosity is in a range from 1 mPa·s to 20 mPa·s. Here, the recording liquid which is used for the head 61T is the above-described recording liquid including the components except for the colorant.

In the image forming apparatus 100 having such a configuration, when a predetermined signal for starting image formation is input, the intermediate transfer body 37 starts rotating in the A1 direction, while facing the heads 61Y, 61M, 61C, and 61BK. The coating roller 74 is rotationally driven by this rotation. By the rotationally driven coating roller 74, the process liquid is applied to a region corresponding to the image formable area on the peripheral surface of the intermediate transfer body 37.

The peripheral surface of the intermediate transfer body 37, on which the process liquid is applied, moves in the A1 direction, and the peripheral surface reaches the area facing the heads 61Y, 61M, 61C, and 61BK. Then, while the intermediate transfer body 37 is rotating in the A1 direction, the yellow recording liquid, the magenta recording liquid, the cyan recording liquid, and the black recording liquid are discharged from the corresponding heads 61Y, 61M, 61C, and 61BK, which function as the first head. In this manner, an image is temporarily supported on the intermediate transfer body 37.

At this time, the discharging timings of the recording liquids are sequentially shifted from the upstream side to the downstream side in the A1 direction, so that image areas of yellow, magenta, cyan, and black are superposed at the same position on the peripheral surface of the intermediate transfer body 37. The image area, which is formed by superposing the recording liquids in the corresponding colors, is the first area (the image portion). Additionally, the colorless and transparent recording liquid is discharged from the head 61T, which functions as the second head, onto the second area. The second area is the non-image portion, which is an inverted area of the image portion.

In this manner, the recording liquids are adhered to the whole image formable area. Thus, in the whole image formable area, the recording liquids which are discharged from the corresponding heads 61Y, 61M, 61C, 61BK, and 61T are adhered to the process liquid. The recording liquids contact and mix with the process liquid. By this, the phase of the process liquid is inverted from the W/O emulsion to the O/W emulsion.

Along with this change, the viscosity of the recording liquids is increased. To be more specific, the viscosity of the mixture of the recording liquids and the process liquid is increased. At the same time, the water-soluble polymer and the colorants are released into the water phase, and thickening and/or condensation are/is caused by the reaction between the water-soluble polymer and the colorants.

Since the process liquid is applied to the intermediate transfer body 37 during the phase of the W/O emulsion, in which the viscosity is relatively low, prior to the start of thickening, the coating amount adjusting device 76 can suitably adjust the coating amount. Accordingly, the process liquid can be uniformly applied on the surface of the intermediate transfer body 37. Since the phase of the W/O emulsion is relatively stable, the physical properties of the process liquid do not change significantly, until the process liquid is applied to the intermediate transfer body 37 and the viscosity of the process liquid starts increasing. Accordingly, the process liquid can be suitably stored in the process liquid tank 75 or on the coating roller 74. The thickening reaction or the like is caused by the adhesion of the recording liquids. Consequently, such a reaction occurs uniformly, and unevenness is prevented. In this manner, image distortion is prevented or suppressed, and image density and color reproducibility are ensured. Thus, a high-definition and high resolution image can be formed.

Since the recording liquids adhere to the process liquid on the whole image formable area, the portion of the O/W emulsion on the surface of the intermediate transfer body 37 forms a layer, which covers the image formable area. The layer, namely, a reaction layer, is formed by the adhesion of the recording liquids onto the surface portion of the process liquid. Thus, the reaction layer is formed on the surface of the layer of the process liquid. The reaction layer covers the layer formed of the process liquid (process liquid layer) on the surface of the intermediate transfer body 37. Here, whether the process liquid layer remains after the reaction which is caused by the adhesion of the recording liquids depends on the thickness of the layer of the process liquid, which is applied on the intermediate transfer body 37 prior to the adhesion of the recording liquids. In this embodiment, the coating amount adjusting device 76 adjusts the thickness of the layer of the process liquid (thickness of the process liquid layer), which is formed on the surface of the intermediate transfer body 37, so that the process liquid layer remains after the reaction.

The registration rollers 34 feed one transfer paper sheet S, which is fed from the paper feed unit 20, to the transfer portion 31, in synchronization with the timing at which the front tip of the image which is supported on the intermediate transfer body 37 reaches the transfer portion 31. At the timing at which the front tip of the transfer paper sheet S enters the transfer portion 31, the transfer roller 38, which has been separated from the intermediate transfer body 37, moves toward the intermediate transfer body 37, and the transfer paper sheet S is nipped between the intermediate transfer roller 37 and the transfer roller 38. In this state, while being rotated by the intermediate transfer body 37, the transfer roller 38 causes the image, which is supported on the intermediate transfer body 37, to be transferred onto the surface of the transfer paper sheet S, by pressing the transfer paper sheet S which is passing through the transfer portion 31, so that the transfer paper sheet S is adhered to the intermediate transfer body 37.

By this transfer process, the image is formed on the transfer paper sheet S. In this transfer process, the above-described reaction layer having the image is removed from the process liquid layer formed of the low polarity solvent, the image is separated from the process liquid layer, and the image adheres to the transfer paper sheet S. The transfer roller 38 causes the recording liquids, whose viscosity is increased by the phase inversion reaction, to be transferred from the intermediate transfer body 37 onto the transfer paper sheet S.

Accordingly, image deletion is prevented. Even if a plain paper sheet is used as the transfer paper sheet S, the feathering, the bleeding, the curling, and the waving are prevented from occurring. Further, during the transfer process, the process liquid layer is covered by the reaction layer, and the process liquid layer is not exposed to the transfer paper sheet S. Thus, adhesion of the process liquid to the transfer paper sheet S is prevented, during the transfer process. Thus, stickiness is prevented, which may be caused by adhesion of the process liquid to the transfer paper sheet S. Here, eve if the process liquid adheres to the transfer paper sheet S, since the process liquid is formed of the low polarity solvent, the curling and the waving are prevented from occurring.

Further, since the reaction layer, whose viscosity is increased by the phase inversion reaction, is removed from the process liquid layer which is formed of the low polarity solvent, the transfer ratio of the recording liquids from the intermediate transfer body 37 to the transfer paper sheet S is large. Accordingly, in some cases, the cleaning device 40 may clean the intermediate transfer body 37, not on the steady basis. In this case, the cleaning member may be made to suitably contact or separate from the intermediate transfer body 37. In this manner, the durability of the cleaning member and the intermediate transfer body 37 can be improved. Further, with such a configuration, the amount of the process liquid which is removed by the cleaning can be reduced, and the amount of the supply of the process liquid to the intermediate transfer body 37 by the coating device 73 can be reduced. Consequently, consumption of the process liquid can be reduced.

Here, if the transfer ratio of the recording liquids from the intermediate transfer body 37 to the transfer paper sheet S is so large that the cleaning of the intermediate transfer body 37 by the cleaning device 40 is not required, the cleaning device 40 may be omitted.

As descried above, these advantages are achieved by adjusting, by the coating amount adjusting device 76, the thickness of the process liquid layer which is formed on the surface of the intermediate transfer body 37, so that the process liquid layer remains after the phase inversion reaction. However, the thickness of the process liquid layer is not limited to this.

The transfer paper sheet S, on which the image is formed by the transfer process, is sent by the rotations of the intermediate transfer body 37 and the transfer roller 38, and the transfer paper sheet S is guided to the paper discharge tray 25. Then, the transfer paper sheet S is discharged onto the paper discharge tray 25. At this time, since the curling and the waving of the transfer paper sheet S are prevented, the stacking state of the transfer paper sheet S on the paper discharge tray 25 is good. After that, the transfer paper sheet S can be easily handled. Further, since the diffusion of the recording liquids into the transfer paper sheet S is improved (improved permeability) by the transfer roller 38, the recording liquids can be prevented from being transferred from the transfer paper sheet S to a reverse side of another transfer paper sheet S, when the transfer paper sheet S is stacked on the paper discharge tray 25.

As the intermediate transfer body 37 rotates in the A1 direction, the coating roller 74 applies and supplies the process liquid onto the intermediate transfer body 37, depending on the consumed amount of the process liquid by the transferring of the reaction layer onto the transfer paper sheet S, and the amount of the process liquid removed by the cleaning device 40 for a case in which the cleaning is performed.

According to the image forming apparatus 100, the following advantages can be achieved. In order to enable high speed image formation, a quick drying property of a recording liquid may be required. In general, absorbability of such a recording liquid by a transfer paper sheet S is high. In this case, the recording liquid penetrates deep into the transfer paper sheet S. When the recording liquid having the quick drying property is used, the recording liquid may strike through the transfer paper sheet S. Thus, the recording liquid having the quick drying property is not suitable for double-sided image formation. However, for the case of the recording liquid according to the embodiment, the absorbability by the transfer paper sheet S is reduced by the thickening, which is caused by the phase inversion reaction. Thus, the strike-through is prevented. The image forming method according to the embodiment is also suitable for double-sided image formation.

The above-described effect of preventing occurrence of the waving and the curling of the transfer paper sheet S is achieved by reducing the absorbability of the recording liquid by the transfer paper sheet S. At the same time, the effect is achieved by pushing the thickened recording liquid into paper fiber holes by the pressure of the transfer roller 38. For the case of the image forming apparatus 100, the viscosity of the recording liquid is increased. The recording liquid does not penetrate so deep into the transfer paper sheet S, and the quick drying property may be reduced, compared to a case where the viscosity does not change. However, while the transfer roller 38 transfers the recording liquid from the intermediate transfer body 37 to the transfer paper sheet S, the transfer roller 38 also applies pressure to the recording liquid and the transfer paper sheet S between the transfer roller 38 and the intermediate transfer body 37, thereby improving the diffusion of the recording liquid into the transfer paper sheet S (improved permeability). In this respect, the transfer roller 38 and the intermediate transfer body 37 function as a pressure applying unit.

The application of the pressure in the fixing process is performed so as to ensure the quick drying property, and to improve a fixing property of the thickened recording liquid to the transfer paper sheet S, especially, to improve a fixing property of the colorant in the recording liquid, by pressing the transfer paper sheet S between the intermediate transfer body 37 and the transfer roller 38. Since the transfer roller 38 and the intermediate transfer body 37 also function as the pressure applying unit, the configuration of the image forming apparatus 100 is simplified, thereby facilitating downsizing and cost reduction.

The image forming apparatus 100 is an image forming apparatus based on an indirect method, in which the intermediate transfer body 37 is used as the recording medium. However, as described below, the recording medium may be a medium on which a final image is formed, such as a plain paper sheet.

Figure 3:
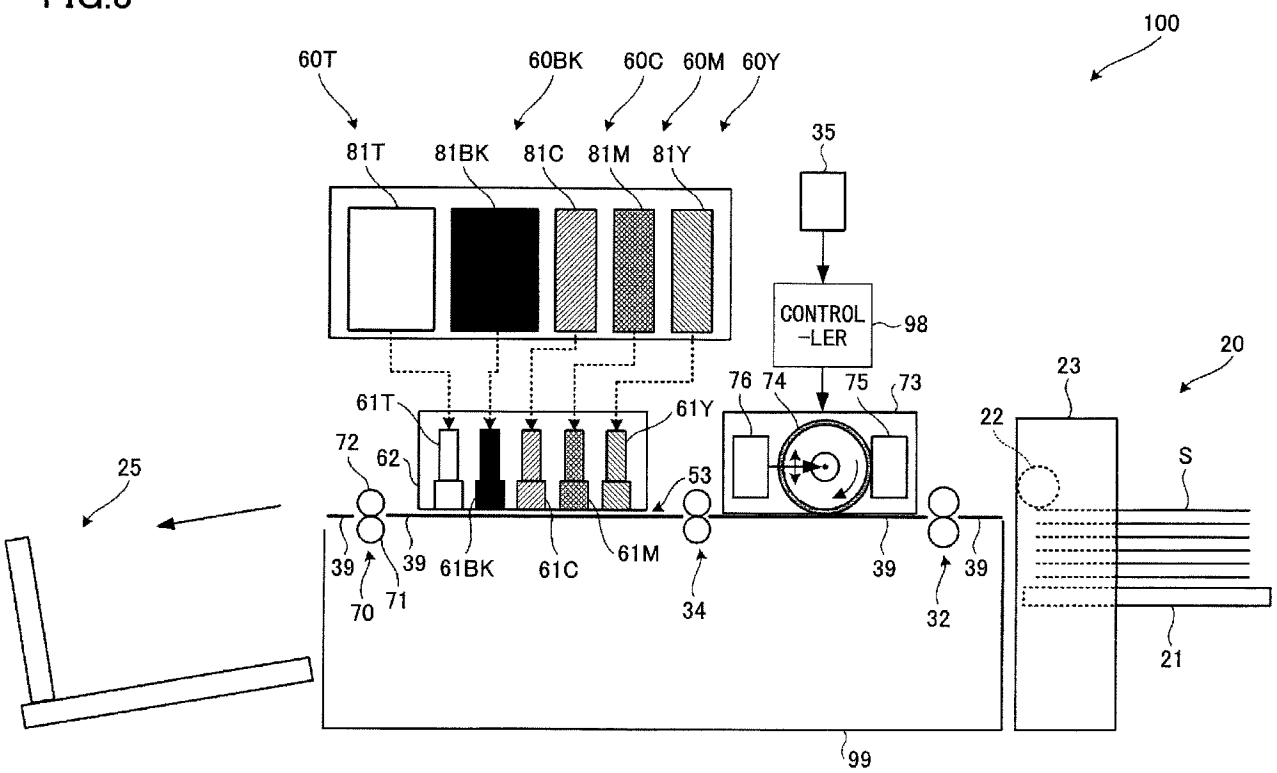
FIG. 3 is a schematic front view of an image forming apparatus according to another example.

FIG. 3 shows an outline of an example of the image forming apparatus according to the embodiment of the present invention, in which a paper sheet S is used as a recording medium. Here, the paper sheet S is a recording paper sheet such as a plain paper sheet. In the image forming apparatus 100 of FIG. 3, the same reference numeral is attached to a component which corresponds to a component included in the image forming apparatus 100 of FIG. 1, and thereby the duplicated explanations are omitted. Hereinafter, the image forming apparatus 100 of FIG. 3 is explained in the points which are different from those of the image forming apparatus 100 of FIG. 1.

The image forming apparatus 100 of FIG. 3 does not include the intermediate transfer body 37 and the transfer roller 38, which are included in the image forming apparatus 100 of FIG. 1. Further, the image forming apparatus 100 of FIG. 3 directly forms an image on the paper sheet S at a discharging portion 53 of the recording liquids, at which the heads 61Y, 61M, 61C, 61BK, and 61T face the guide plate 39. The image forming apparatus 100 of FIG. 3 is an image forming apparatus based on a direct method.

Since the image forming apparatus 100 of FIG. 3 does not include the intermediate transfer body 37 and the transfer roller 38, which are included in the image forming apparatus 100 of FIG. 1, the image forming apparatus 100 of FIG. 3 includes a pressure applying unit 70. Here, the pressure applying unit 70 may be omitted. Incidentally, the image forming apparatus 100 of FIG. 1 may include a pressure applying unit 70, which is disposed at a position which is downstream of the transfer portion 31 and upstream of the paper discharge tray 25.

In the image forming apparatus 100 of FIG. 3, the pressure applying unit 70 is disposed at a position which is downstream of the discharging portion 53 and upstream of the paper discharge tray 25 in a direction in which the paper sheet S is conveyed. The pressure applying unit 70 includes a pressure roller 71, a pressure roller 72, and a motor (not shown). The pressure roller 71 and the pressure roller 72 are pressed against each other. The motor rotationally drives the pressure roller 71, and causes the pressure roller 72 to be rotationally driven. The pressure applying unit 70 has a configuration such that the paper sheet S, on which the recording liquids are discharged at the discharging portion 53, passes through the nip between the pressure rollers 71 and 72. The pressure between the pressure rollers 71 and 72 is the same as the pressure between the transfer roller 38 and the intermediate transfer body 37, where the transfer roller 38 and the intermediate transfer body 37 are pressed against each other.

In the image forming apparatus 100 of FIG. 3, when a predetermined signal for starting image formation is input, one paper sheet S is fed from the paper feed unit 20, and subsequently the paper sheet S is sent toward the coating device 73. After passing through the conveyance rollers 32, the coating device 73 applies the process liquid onto an image formable area on the side of the paper sheet S, on which the recording liquids are applied at the discharging portion 53. Subsequently, the paper sheet S is fed into the discharging portion 53 at suitable timing by the registration rollers 34. Then, during a process in which the paper sheet S passes through the discharging portion 53, similar to the image forming apparatus 100 of FIG. 1, the heads 61Y, 61M, 61C, 61BK, and 61T discharge the corresponding recording liquids onto the image formable area of the paper sheet S, on which the process liquid is applied.

The above-described phase inversion reaction is caused when the recording liquids adhere to the process liquid, and a reaction layer having an image is formed on the paper sheet S. The coating device 73 applies a necessary and sufficient amount of the process liquid, which is adjusted by the coating amount adjusting device 76, for causing the phase inversion reaction on the paper sheet S. However, it may be difficult to adjust the necessary and sufficient amount of the process liquid. In this case, in order to ensure that the phase inversion reaction is caused, the coating device 73 applies an amount of the process liquid, which is greater than the necessary and sufficient amount of the process liquid, to the paper sheet S. In this case, the process liquid directly contacts the paper sheet S. However, as described above, even if the process liquid adheres to the paper sheet S, since the process liquid is formed mainly of the low polarity solvent, the curling and waving of the paper sheet S can be prevented. Further, as described above, even if the paper sheet S is a plain paper sheet, the feathering and the bleeding of the image can be prevented by the thickening of the recording liquids, which is caused by the phase inversion reaction.

Additionally, for the image forming apparatus 100 of FIG. 3, the following advantages can be achieved. Here, the advantages are the same as those of the image forming apparatus of FIG. 1. Namely, because of the increase in viscosity of the recording liquids, absorbability of the recording liquids into the paper sheet S is reduced, and the strike-through of the recording liquids can be prevented. The advantage is that the image forming apparatus 100 of FIG. 3 is suitable for double-sided image formation. Another advantage is that deformation of the paper sheet S such as the waving and curling can be prevented by pressing the paper sheet S by the pressing rollers 71 and 72, so that the thickened recording liquids are pushed into the paper fiber holes. In addition, by this advantage, conveyability of the paper sheet S supporting an image is improved, and the paper jamming can be prevented. The advantage is that it becomes easier to handle the paper sheet S. When the paper sheet S, on which the image is formed at the discharging portion 53, passes through the pressure applying unit 70, pressure is applied to the paper sheet S and to the recording liquids. Another advantage is that diffusion of the recording liquids into the paper sheet S is improved. By the application of the pressure, the quick drying property of the recording liquids can be ensured. In addition, the application of the pressure improves the fixing property of the recording liquids on the paper sheet S, especially, the fixing property of the colorants included in the recording liquids, and improves the smoothness of dots of the recording liquids. Another advantage is that brightness of the image can be improved. After the paper sheet S passes through the pressure applying unit 70, the diffusion of the recording liquids into the paper sheet S is improved by the pressure applying unit 70. Another advantage is that, when the paper sheet S is stacked onto the paper discharge tray 25, the recording liquids can be prevented from transferring to a reverse side of another paper sheet S.

In the image forming apparatus 100 of FIG. 1 and the image forming apparatus 100 of FIG. 3, after applying the process liquid onto the intermediate transfer body 37 or the paper sheet S as the recording medium by the coating device 73, the heads 61Y, 61M, 61C, 61BK, and 61T discharge the recording liquids, and the recording liquids are adhered to the paper sheet S. Namely, in the image forming apparatus 100, the process liquid is applied in advance. The configuration in which the process liquid is applied in advance has an advantage such that distortion of the image is not easily generated and high image quality is achieved, compared to a configuration in which the process liquid is applied subsequently. Namely, in the configuration in which the process liquid is applied subsequently, the heads 61Y, 61M, 61C, 61BK, and 61T discharge the recording liquids, and the recording liquids are adhered to the intermediate transfer body 37 or the paper sheet S. Subsequently the coating device 73 applies the process liquid.

If the process liquid is applied subsequently in the indirect method, the process liquid is applied to the intermediate transfer body 37, after the recording liquids are adhered to the intermediate transfer body 37 as the recording medium. Accordingly, during application of the process liquid, the image on the intermediate transfer body 37 may be distorted. If the process liquid is applied subsequently in the direct method, bleeding of the recording liquids may occur at the time at which the recording liquids are adhered to the paper sheet S as the recording medium, and image distortion may be caused by the bleeding of the recording liquids. After that, during application of the process liquid, distortion of the image may be caused.

However, for example, if a configuration is adopted in the coating device 73 such that a head discharges the process liquid, image distortion during application of the process liquid may be suppressed. Further, even if the recording medium is the paper sheet S, if the paper sheet S is a dedicated paper sheet in which the bleeding of the recording liquids hardly occurs, or if the recording medium is a medium such as a film on which the recording liquids do not blur, the image distortion may be suppressed. Thus, the configuration in which the process liquid is applied subsequently may be adopted, provided that some techniques which sufficiently suppress the image distortion are combined with the configuration.

When the configuration is adopted in which the head discharges the process liquid, the following advantages can be achieved. Namely, it is possible to apply the process liquid only to the first area, and the coating amount of the process liquid can be strictly controlled. An advantage is that consumption of the process liquid can be reduced. Since the process liquid is applied only to the first area, a second head may not be required. The second head is for adhering the recording liquids to the process liquid in the second area. Another advantage is that, by omitting the second head, the apparatus can be downsized, the control can be easier, and the cost can be reduced. Further, the recording liquids for the second head may not be required. Another advantage is that the running cost can be reduced. Another advantage is that, since the process liquid is only applied to the first area, stickiness, which may be caused by the process liquid, can be prevented in the non-image portion.

Additionally, an amount and an area of the W/O emulsion, which remains after the phase inversion reaction, can be controlled. If the W/O emulsion adheres to the transfer paper sheet S or the paper sheet S, the curling and waving of the transfer paper sheet S or the paper sheet S may occur. Since the amount of the remaining W/O emulsion can be reduced, the curling and waving can be suppressed. Here, in order to discharge the process liquid by the head, certain considerations may be required, so that the phase of the W/O emulsion is preserved. For example, the size of the droplets of the process liquid may be suitably adjusted.

The second head can be omitted, even if the configuration is not adopted in which the head discharges the process liquid. In this case, the reaction layer is only formed on the image portion, namely, on the first area. The non-image portion includes the process liquid layer. In this case, the process liquid adheres to the transfer paper sheet S or the paper sheet S. However, since the process liquid is formed mainly of the low polarity solvent, the curling and waving can be suppressed.

By the following experiments, it was examined how an image was formed by using the process liquid and the recording liquids, for which the above-described conditions were considered. The following items were examined:

(1) character quality,
(2) bleeding,
(3) dots reproducibility,
(4) curling, and
(5) transferability.

In order to compare these items, examples 1-8 and comparative examples 1-4 were used. The item (5) was evaluated only in examples 4-6 and 8, and comparative examples 2 and 4.

<Image Forming Conditions>

Heads of a commercially available inkjet printer (GX-5000, a product of Ricoh Company, Ltd.), which are equivalent to the heads 61Y, 61M, 61C, and 61BK, were charged with recording liquids, whose compositions and weight ratios were prepared as described below. Then, an image was formed. Discharging of the colorless and transparent recording liquid was omitted. Images for evaluation were formed by using plain paper sheets (My Paper, a product of Ricoh Company Ltd.) as recording media in the examples 1-3 and 7, and in the comparative examples 1 and 3, and the items (1)-(4) were evaluated (for the examples 4-6 and 8, and the comparative examples 2 and 4, the item (5) was evaluated). Further, in the examples 4-6 and 8, and in the comparative examples 2 and 4, where the item (5) was evaluated, a silicone rubber sheet having a thickness of 0.5 mm was used as the intermediate transfer body (as a recording medium). In these cases, the items (1)-(5) were evaluated by forming an image for evaluation on the silicone rubber sheet, and by transferring the image for the evaluation onto the plain paper sheet. The transfer was performed as follows. Namely, the plain paper sheet was fixed to the silicone rubber sheet so that the plain paper sheet overlapped the image for evaluation. Then, the silicone rubber sheet and the plain paper sheet were passed through the nip between silicone-coated two rubber rollers. Here, a force of 30 kgf was applied to the two rubber rollers, and the rubber rollers were rotated at peripheral line speed of 50 mm/s.

Example 1

The process liquid was as described below.

<Process Liquid>

SENKAACTGEL CM100 (W/O emulsion including polymethacrylic ester-based cationic polymers, solid content 35%, produced by SENKA corporation): 100% by mass The process liquid was applied to the plain paper sheet by using a roller, so that the coated amount became 70 mg/A4, and an image for evaluation was formed by the recording liquids described below.

The recording liquids were as described below.

<Black Recording Liquid> sulfonated carbon black pigment dispersion liquid (CAB-O-JET-200, solid content 20% by mass, produced by Cabot Corporation): 35.0% by mass
2-pyrrolidone: 10.0% by mass
glycerin: 14.0% by mass
propylene glycol monobutyl ether: 0.9% by mass
dehydroacetate soda: 0.1% by mass
distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

<Yellow Recording Liquid> sulfonated yellow pigment dispersion liquid (CAB-O-JET-270Y, solid content 10% by mass, produced by Cabot Corporation): 40.0% by mass
triethylene glycol: 15.0% by mass
glycerin: 25.0% by mass
propylene glycol monobutyl ether: 6.0% by mass
dehydroacetate soda: 0.1% by mass
distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

<Magenta Recording Liquid> sulfonated magenta pigment dispersion liquid (CAB-O-JET-260M, solid content 10% by mass, produced by Cabot Corporation): 40.0% by mass
diethylene glycol: 20.0% by mass
propylene glycol monobutyl ether: 3.0% by mace
dehydroacetate soda: 0.1% by mass
distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

<Cyan Recording Liquid>.

sulfonated cyan pigment dispersion liquid (CAB-O-JET-250C, solid content 10% by mass, produced by Cabot Corporation): 40.0% by mass
ethylene glycol: 4.0% by mass
triethylene glycol: 14.0% by mass
propylene glycol monobutyl ether: 6.0% by mass
dehydroacetate soda: 0.1% by mass
distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

Example 2

The process liquid was as described below. Other conditions were the same as those of the example 1.

<Process Liquid>

SENKAACTGEL AP200 (W/O emulsion including polyacrylic acid salt-based anionic polymers, solid content 35%, produced by SENKA corporation): 100% by mass

Example 3

The process liquid was as described below. Other conditions were the same as those of the example 1.

<Process Liquid>

SENKAACTGEL NS100 (W/O emulsion including polyacrylamide nonionic polymers, solid content 35%, produced by SENKA corporation): 100% by mass

Example 4

The process liquid which was the same as that of the example 1 was used. The process liquid was applied onto the silicone rubber sheet by the roller, so that the coated amount became 70 mg/A4. An image for evaluation was formed by the recording liquids of the example 1, and the image was transferred as described above.

Example 5

The process liquid which was the same as that of the example 2 was used. The process liquid was applied onto the silicone rubber sheet by the roller, so that the coated amount became 70 mg/A4. An image for evaluation was formed by the recording liquids of the example 1, and the image was transferred as described above.

Example 6

The process liquid which was the same as that of the example 3 was used. The process liquid was applied onto the silicone rubber sheet by the roller, so that the coated amount became 70 mg/A4. An image for evaluation was formed by the recording liquids of the example 1, and the image was transferred as described above.

Example 7

The composition of the recording liquid was as described below. Other conditions were the same as those of the example 1. Here, the recording liquids in the corresponding colors of this example were different from the recording liquids in the corresponding colors of the example 1 in the point that a surfactant having the component described below was added. Here, the HLB value of the component was in a range from 8 to 15.

polyoxyethylene lauryl ether

The addition was performed so as to facilitate the phase inversion from the W/O emulsion to the O/W emulsion by the surfactant having the HLB value in the range from 8 to 15.

<Black Recording Liquid> sulfonated carbon black pigment dispersion liquid (CAB-O-JET-200, solid content 20% by mass, produced by Cabot Corporation): 35.0% by mass 2-pyrrolidone: 10.0% by mass glycerin: 14.0% by mass propylene glycol monobutyl ether: 0.9% by mass dehydroacetate soda: 0.1% by mass polyoxyethylene (4.2 mole) lauryl ether (NIKKOL BL-4.2, HLB: 11.5, produced by NIKKO CHEMICALS CO., LTD.): 2.0% by mass distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

<Yellow Recording Liquid> sulfonated yellow pigment dispersion liquid (CAB-O-JET-270Y, solid content 10% by mass, produced by Cabot Corporation): 40.0% by mass triethylene glycol: 15.0% by mass glycerin: 25.0% by mass propylene glycol monobutyl ether: 6.0% by mass dehydroacetate soda: 0.1% by mass polyoxyethylene (4.2 mole) lauryl ether (NIKKOL BL-4.2, HLB: 11.5, produced by NIKKO CHEMICALS CO., LTD.): 2.0% by mass distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

<Magenta Recording Liquid> sulfonated magenta pigment dispersion liquid (CAB-O-JET-260M, solid content 10% by mass, produced by Cabot Corporation): 40.0% by mass diethylene glycol: 20.0% by mass propylene glycol monobutyl ether: 3.0% by mass dehydroacetate soda: 0.1% by mass polyoxyethylene (4.2 mole) lauryl ether (NIKKOL BL-4.2, HLB: 11.5, produced by NIKKO CHEMICALS CO LTD.): 2.0% by mass distilled water: remaining amount After that, pH of the mixture was adjusted to be 9.1 by a 5% by weight aqueous solution of lithium hydroxide, and the resultant mixture was pressure-filtered by a membrane filter having an average pore diameter of 0.8 μm.

<Cyan Recording Liquid> sulfonated cyan pigment dispersion liquid (CAB-O-JET-250C, solid content 10% by mass, produced by Cabot Corporation): 40.0% by mass ethylene glycol: 4.0% by mass triethylene glycol: 14.0% by mass propylene glycol monobutyl ether: 6.0% by mass dehydroacetate soda: 0.1% by mass polyoxyethylene (4.2 mole) lauryl ether (NIKKOL BL-4.2, HLB: 11.5, produced by NIKKO CHEMICALS CO., LTD.): 2.0% by mass distilled water: remaining amount After that, pH of the mixture was adjusted to be 9.1 by a 5% by weight a solution of lithium hydroxide, and the resultant mixture was pressure-filtered by a membrane filter having an average pore diameter of 0.8 μm.

Example 8

The recording liquids which were the same as those of example 7 were used. Other conditions were the same as those of the example 4.

Comparative Example 1

The process liquid was not used. Other conditions were the same as those of the example 1.

Comparative Example 2

The process liquid was not used. Other conditions were the same as those of the example 4.

Comparative Example 3

The process liquid as described below was used. Other conditions were the same as those of the example 1.

<Process Liquid> magnesium nitrate: 25.0% by mass glycerin: 8.0% by mass diethylene glycol: 10.0% by mass polyoxyethylene alkyl ether: 2.0% by mass distilled water: remaining amount Comparative Example 4

The process liquid which was the same as that of the comparative example 3 was used. Other conditions were the same as those of the example 4.

<Evaluation Criteria>

The evaluation criteria of the items (1)-(5) are as described below.

(1) Character Quality

Black characters were evaluated. Based on visual observation, the character in which the feathering was not detected was denoted by ○, the character in which the feathering was not significantly detected was denoted by Δ, and the character in which the feathering was detected was denoted by x.

(2) Bleeding

The adjacent solid images in corresponding colors of black, yellow, magenta, and cyan were evaluated. Based on visual observation, the images for which the bleeding was not detected in the boundary portions of the corresponding colors was denoted by ○, the images for which the bleeding was not significantly detected in the boundary portions of the corresponding colors was denoted by Δ, and the images for which the bleeding was detected in the boundary portions of the corresponding colors was denoted by x.

(3) Dots Reproducibility

Dots in the corresponding colors of black, yellow, magenta, and cyan were evaluated. Based on microscope observation (500 times magnification), the dot whose dot shape was highly defined and color unevenness was not observed within the dot was denoted by ○, the dot whose dot shape was slightly distorted was denoted by Δ, and the dot whose dot shape was distorted was denoted by x.

(4) Curling

The image used for evaluation of curling was a solid pattern of 300 dpi×300 dpi. The solid pattern was printed by discharging the recording liquids at approximately 40 pl/drop from the heads. After printing, the printed surface was directed downwardly, and after ten seconds were elapsed, the height of the edge of the paper sheet was evaluated. The paper sheet whose height of the edge from the surface on which the paper sheet was disposed was less than or equal to 10 mm was denoted by ○, the paper sheet which was curled into a cylindrical shape was denoted by x, and the paper whose condition was between ○ and x was denoted by Δ.

(5) Transferability

The black solid image which was used for the evaluation of the item (2) was transferred from the silicone rubber sheet to the paper sheet. The image which was remaining on the silicone rubber sheet was removed by Printac C (produced by Nitto Denko Corporation), and the removed image was adhered to stacked paper sheets. The image density was evaluated by measuring the substrate surface of the Printac C by a reflection densitometer (X-Rite 939, produced by X-Right, Inc.). The image whose image density was less than or equal to 0.2 was denoted by ○, and the image other than that was denoted by x.

<Evaluation Result>

Table 1 below shows the evaluation results of the examples 1-8, and the evaluation results of the comparative examples 1-4.

TABLE 1

| | (1) Character quality | (2) Bleeding | (3) Dot Reproducibility | (4) Curling | (5) Transferability |
|---|---|---|---|---|---|
| Example 1 | ○ | ○ | ○ | ○ | |
| Example 2 | Δ | Δ | Δ | ○ | |
| Example 3 | ○ | ○ | ○ | ○ | |
| Example 4 | ○ | ○ | ○ | Δ | ○ |
| Example 5 | Δ | Δ | Δ | Δ | ○ |
| Example 6 | ○ | ○ | ○ | Δ | ○ |
| Example 7 | ○ | ○ | ○ | ○ | |
| Example 8 | ○ | ○ | ○ | Δ | ○ |
| Comparative Example 1 | x | x | x | x | |
| Comparative Example 2 | x | x | x | x | x |
| Comparative Example 3 | Δ | Δ | x | x | |
| Comparative Example 4 | Δ | Δ | x | x | x |

From the table, it is confirmed that, by the image forming method in which an image is formed by using the aqueous recording liquids and the process liquid according to the embodiment of the present invention, substantially good results were obtained for the items (1)-(4), and good results were obtained for the item (5).

Hereinabove, the embodiment of the present invention is explained. However, the present invention is not limited to the specifically disclosed embodiment, and variations and modifications may be made without departing from the scope of the present invention.

For example, an image forming apparatus to which the embodiment of the present invention is applied is not limited to the above-described image forming apparatus. Namely, the embodiment of the present invention may be applied to a copier, a facsimile machine, a combined machine thereof, a monochrome combined machine thereof, or an image forming apparatus which is used for printing a printed circuit board. Further, the embodiment of the present invention may be applied to an image forming apparatus which is for forming a predetermined image in the field of biotechnology.

The shape of the intermediate transfer body is not limited to the roller shape. The intermediate transfer body may have an endless belt shape. In the image forming apparatus based on the direct method, an endless belt shaped member may be used for conveying a recording medium.

The number of the heads depends on usage of the image forming apparatus. The number may be more than two, or the number may be one. For a case where the image forming apparatus includes a plurality of heads, the number of the heads is not limited to four. The image forming apparatus may include four or more heads. For example, in addition to the four heads, the image forming apparatus may include heads for discharging light-colored recording liquids, such as a light cyan recording liquid and a light magenta recording liquid. Depending on functions of an image forming apparatus, the image forming apparatus may include at least one of the first head and the second head.

The above-described effects are suitable effects which are caused by the embodiment of the present invention. The effects of the present invention are not limited to the above-described effects.

The present application is based on and claims the benefit of priority of Japanese Priority Applications No. 2012-200455 filed on Sep. 12, 2012, and No. 2013-130932 filed on Jun. 21, 2013, the entire contents of which are hereby incorporated herein by reference.

What is claimed is:

1. An image forming apparatus comprising:

a head configured to discharge an aqueous recording liquid onto a recording medium; and a coating unit configured to apply a process liquid onto the recording edit, wherein the process liquid is formed by emulsifying, by a first surfactant, water including a water-soluble polymer and a low polarity solvent which is not compatible with the water, wherein the water and the low polarity solvent are emulsified as a W/O emulsion in which the water is in a dispersed phase and the low polarity solvent is in a continuous phase, wherein at least one of the aqueous recording liquid and the process liquid includes a second surfactant, wherein the second surfactant causes an emulsified phase of the process liquid to be phase-inverted from the W/O emulsion to an O/W emulsion, and wherein, when the head discharges the aqueous recording liquid, and when the aqueous recording liquid and the process liquid contact each other, the emulsified phase of the process liquid is phase-inverted from the W/O emulsion to the O/W emulsion by the second surfactant.

2. The image forming apparatus according to claim 1, wherein the recording medium is an intermediate transfer body, and wherein the coating unit applies the process liquid onto the intermediate transfer body, and subsequently the head discharges the aqueous recording liquid.

3. The image forming apparatus according to claim 1, wherein the recording medium is a recording paper sheet, and wherein the coating unit applies the process liquid onto the recording paper sheet, and subsequently the head discharges the aqueous recording liquid.

4. The image forming apparatus according to claim 1, further comprising:

an environment detection sensor configured to detect an environmental temperature and/or an environmental humidity, wherein an image is formed in the image forming apparatus under the environmental temperature and/or the environmental humidity; and a process liquid amount control unit configured to control an amount of the process liquid, the process liquid being applied onto the recording medium by the coating unit, based on the environmental temperature and/or the environmental humidity detected by the environment detection sensor.

5. The image forming apparatus according to claim 1, wherein the head includes a first head configured to discharge the aqueous recording liquid including a colorant, and a second head configured to discharge the aqueous recording liquid not including the colorant, wherein, in an area on the recording medium onto which the process liquid is applied by the coating unit, the first head discharges the aqueous recording liquid including the colorant onto a first area, and the second head discharges the aqueous recording liquid not including the colorant onto a second area, and wherein the first area is different from the second area.

6. An image forming apparatus comprising:

a head configured to discharge an aqueous recording liquid onto a recording medium; and a coating unit configured to apply a process liquid onto the recording medium, wherein the process liquid is formed by emulsifying, by a first surfactant, water including a water-soluble polymer and a low polarity solvent which is not compatible with the water, wherein the water and the low polarity solvent are emulsified as a W/O emulsion in which the water is in a dispersed phase and the low polarity solvent is in a continuous phase, wherein the head includes a first head configured to discharge the aqueous recording liquid including a colorant; and a second head configured to discharge the aqueous recording liquid not including the colorant, wherein, in an area on the recording medium onto which the process liquid is applied by the coating unit, the first head discharges the aqueous recording liquid including the colorant onto a first area, and the second head discharges the aqueous recording liquid not including the colorant onto a second area, and wherein the first area is different the second area.

7. An image forming method of forming an image, the method comprising:

a first step of using a head configured to discharge an aqueous recording liquid onto a recording medium; and a second step of using a coating unit configured to apply a process liquid onto the recording medium, wherein the process liquid is formed by emulsifying, by a first surfactant, water including a water-soluble polymer and a low polarity solvent which is not compatible with the water, wherein the water and the low polarity solvent are emulsified as a W/O emulsion in which the water is in a dispersed phase and the low polarity solvent is in a continuous phase, wherein at least one of the aqueous recording liquid and the process liquid includes a second surfactant, wherein the second surfactant causes an emulsified phase of the process liquid to be phase-inverted from the W/O emulsion to an O/W emulsion, and wherein, when the head discharges the aqueous recording liquid, and when the aqueous recording liquid and the process liquid contact each other, the emulsified phase of the process liquid is phase-inverted from the W/O emulsion to the O/W emulsion by the second surfactant.

* * * * *

UNITED STATES PATENT AND TRADEMARK OFFICE

CERTIFICATE OF CORRECTION

PATENT NO. : 8,944,556 B2
APPLICATION NO. : 13/970091
DATED : February 3, 2015
INVENTOR(S) : Takeshi Hihara et al.

It is certified that error appears in the above-identified patent and that said Letters Patent is hereby corrected as shown below:

Replace the foreign application priority data on the title page of the patent, with the following:

Item -- (65) Sep. 12, 2012 (JP) ..... 2012-200455
Jun. 21, 2013 (JP) ..... 2013-130932 --

Signed and Sealed this
Eleventh Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,944,556 B2
APPLICATION NO. : 13/970091
DATED : February 3, 2015
INVENTOR(S) : Takeshi Hihara et al.

It is certified that error appears in the above-identified patent and that said Letters Patent is hereby corrected as shown below:

Replace the sixth applicant listed in item (71) on the title page of the patent, with the following:

--Hiroyuki Yamashita, Kanagawa (JP)--.

Replace the sixth inventor listed in item (72) on the title page of the patent, with the following:

--Hiroyuki Yamashita, Kanagawa (JP)--.

Signed and Sealed this
Sixteenth Day of February, 2016

Michelle K. Lee

Michelle K. Lee
*Director of the United States Patent and Trademark Office*